US009531060B2

(12) United States Patent
Okano

(10) Patent No.: US 9,531,060 B2
(45) Date of Patent: Dec. 27, 2016

(54) ELECTRONIC DEVICE

(71) Applicant: Kabushiki Kaisha Toshiba, Tokyo (JP)

(72) Inventor: Motochika Okano, Tokyo (JP)

(73) Assignee: KABUSHIKI KAISHA TOSHIBA, Tokyo (JP)

( * ) Notice: Subject to any disclaimer, the term of this patent is extended or adjusted under 35 U.S.C. 154(b) by 131 days.

(21) Appl. No.: 14/459,939

(22) Filed: Aug. 14, 2014

(65) Prior Publication Data

US 2015/0311580 A1 Oct. 29, 2015

(30) Foreign Application Priority Data

Apr. 28, 2014 (JP) ..... 2014-092236

(51) Int. Cl.

| | |
|---|---|
| ***H01Q 1/24*** | (2006.01) |
| ***H01Q 21/20*** | (2006.01) |
| ***H01Q 5/364*** | (2015.01) |
| ***H01Q 5/371*** | (2015.01) |

(52) U.S. Cl.

CPC ..... *H01Q 1/243* (2013.01); *H01Q 5/364* (2015.01); *H01Q 5/371* (2015.01); *H01Q 21/205* (2013.01)

(58) Field of Classification Search

CPC ..... H01Q 1/243; H01Q 21/20; H01Q 3/24; H01Q 9/285; H01Q 9/16; H04B 7/0602; H04B 7/0689; H04B 5/0075; H04W 52/0251; H05K 1/16; Y02B 60/50

See application file for complete search history.

(56) References Cited

U.S. PATENT DOCUMENTS

| | | | | |
|---|---|---|---|---|
| 7,193,562 | B2 * | 3/2007 | Shtrom | H01Q 1/38 343/700 MS |
| 2007/0037619 | A1 * | 2/2007 | Matsunaga | H01Q 1/2291 455/575.7 |
| 2008/0026797 | A1 * | 1/2008 | Nanda | H01Q 1/246 455/562.1 |
| 2008/0152030 | A1 * | 6/2008 | Abramov | H04B 7/0617 375/260 |
| 2010/0285759 | A1 * | 11/2010 | Chung | H01Q 1/243 455/101 |
| 2010/0328216 | A1 | 12/2010 | Honda et al. | |
| 2010/0330940 | A1 * | 12/2010 | Sheynblat | H01Q 1/242 455/129 |
| 2012/0142291 | A1 * | 6/2012 | Rath | H04B 7/0602 455/127.1 |

(Continued)

FOREIGN PATENT DOCUMENTS

| | | | |
|---|---|---|---|
| JP | 2009200600 | A | 9/2009 |
| JP | 2010130482 | A | 6/2010 |
| JP | 2011013854 | A | 1/2011 |

*Primary Examiner* — Sujatha Sharma

(74) *Attorney, Agent, or Firm* — Patterson & Sheridan, LLP

(57) ABSTRACT

According to one embodiment, an electronic device includes a housing, a first antenna, a second antenna, a distributor and a communication module. The first antenna is in a first region of the housing. The second antenna is in a second region of the housing. The distributor is configured to distribute a same signal to the first antenna and the second antenna. The communication module is configured to perform communication by using the first antenna when an antenna of an external device approaches the first region and to perform communication by using the second antenna when the antenna of the external device approaches the second region.

9 Claims, 17 Drawing Sheets

(56) References Cited

U.S. PATENT DOCUMENTS

| | | | | |
|---|---|---|---|---|
| 2012/0286936 | A1* | 11/2012 | Mullen | G06Q 10/00 340/10.2 |
| 2013/0156080 | A1* | 6/2013 | Cheng | H01Q 1/243 375/222 |
| 2014/0141731 | A1* | 5/2014 | Abudul-Gaffoor | H01Q 1/243 455/78 |
| 2014/0192845 | A1* | 7/2014 | Szini | H04B 7/0413 375/219 |
| 2014/0354226 | A1* | 12/2014 | Draaijer | G06F 1/1632 320/108 |
| 2015/0298549 | A1* | 10/2015 | Tamura | B60K 37/00 340/461 |

* cited by examiner

ELECTRONIC DEVICE

CROSS-REFERENCE TO RELATED APPLICATIONS

This application is based upon and claims the benefit of priority from Japanese Patent Application No. 2014-092236, filed Apr. 28, 2014, the entire contents of which are incorporated herein by reference.

FIELD

Embodiments described herein relate generally to an electronic device.

BACKGROUND

An electronic device using near-field communication is provided.

BRIEF DESCRIPTION OF THE DRAWINGS

A general architecture that implements the various features of the embodiments will now be described with reference to the drawings. The drawings and the associated descriptions are provided to illustrate the embodiments and not to limit the scope of the invention.

DETAILED DESCRIPTION

Figure 1:
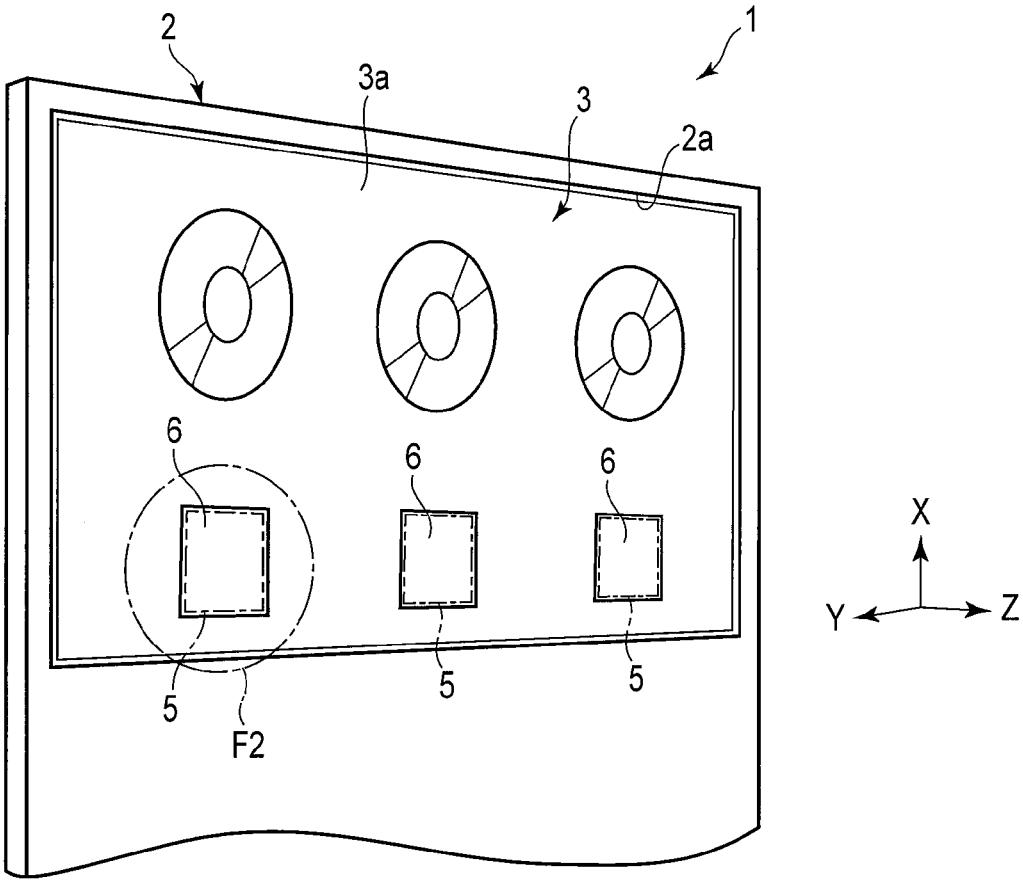
FIG. 1 is an exemplary perspective illustration showing an electronic device according to a first embodiment.

Various embodiments will be described hereinafter with reference to the accompanying drawings.

In general, according to one embodiment, an electronic device comprises a housing, a first antenna, a second antenna, a distributor and a communication module. The housing comprises a first region and a second region. The first antenna is in the first region. The second antenna is in the second region. The distributor is configured to distribute a same signal to the first antenna and the second antenna. The communication module is electrically connected to the distributor. The communication module is configured to perform communication by using the first antenna when an antenna of an external device approaches the first region and to perform communication by using the second antenna when the antenna of the external device approaches the second region.

In this specification, some components are expressed by two or more terms. These terms are merely examples and these components may be expressed by another or other terms. The other components, which are not expressed by two or more terms, may be expressed by another or other terms.

The drawings are merely examples, and may differ from when the embodiments are actually realized in terms of, for example, the relationship between thickness and planar dimension and the ratio of thickness of layers. In the drawings, the relationship or ratio of dimensions may be different from figure to figure.

(First Embodiment)

FIG. 1 to FIG. 7 show an electronic device 1 according to a first embodiment. FIG. 1 shows the outer appearance of the electronic device 1. The electronic device 1 is, for example, a digital signage. Note that an electronic device to which the present embodiment is applicable is not limited to this example. The structure of the present embodiment is widely applicable to various types of electronic devices.

As shown in FIG. 1, the electronic device 1 comprises a housing 2 and a display 3 housed in the housing 2. The display 3 includes a display screen 3*a* configured to display an image or a video. The housing 2 comprises an opening 2*a* configured to expose the display screen 3*a* to the outside. The display 3 is, for example, a liquid-crystal display panel. However, the display 3 is not limited to this example. The display 3 comprises a first surface including the display screen 3*a*, and a second surface located on a side opposite to the first surface.

As shown in FIG. 1, the housing 2 comprises a communication region 6 in which an antenna module (i.e., coupler module) 5 is provided. The antenna module 5 will be explained later. In the display screen 3*a*, for example, an image or a video indicating the position of the communication region 6 (for example, the position of the outer shape) may be displayed, or a display indicating the position of the communication region 6 may be provided by printing, etc.

The antenna module 5 is located, for example, behind the display 3, and faces the second surface of the display 3. The display 3 may comprise a transparent electrode which is liquid-crystalline over the whole display screen 3*a*. Instead of using the transparent electrode, a region corresponding to the communication region 6 (in other words, a region facing the communication region 6) may be formed of, for example, glass only. This structure, in which a transparent electrode is not provided in the region corresponding to the communication region 6, realizes enhancement of communication characteristics of the antenna module 5.

[Mounting Structure of Antenna Module]

Next, this specification explains the mounting structure of the antenna module 5 in detail.

Figure 2:
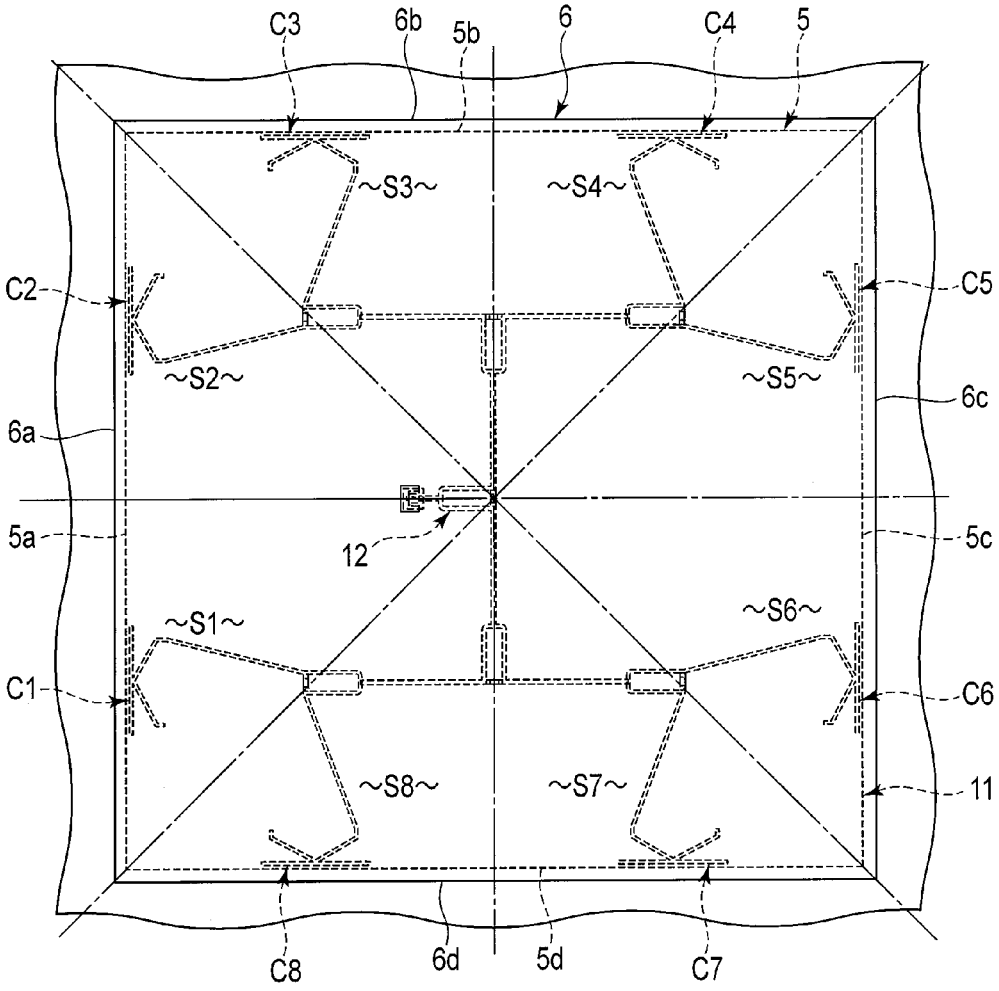
FIG. 2 is an exemplary front view showing the region surrounded by a circle F2 of the electronic device shown in FIG. 1.

FIG. 2 is an enlarged view of the region surrounded by a circle F2 of the electronic device shown in FIG. 1. In the present embodiment, the communication region 6 is, for example, a rectangle having four sides 6*a*, 6*b*, 6*c* and 6*d*. The communication region 6 includes, for example, first to eighth regions S1 to S8. The first region S1 and the second region S2 are provided along the first side 6*a*. The third region S3 and the fourth region S4 are provided along the second side 6*b*. The fifth region S5 and the sixth region S6 are provided along the third side 6*c*. The seventh region S7 and the eighth region S8 are provided along the fourth side 6*d*. Thus, the first to eighth regions S1 to S8 are arranged along the outer frame of the communication region 6 at substantially regular intervals.

As shown in FIG. 2, the antenna module 5 is located in the communication region 6. For example, the outer shape of the antenna module 5 substantially conforms to the outer shape of the communication region 6.

Figure 3:
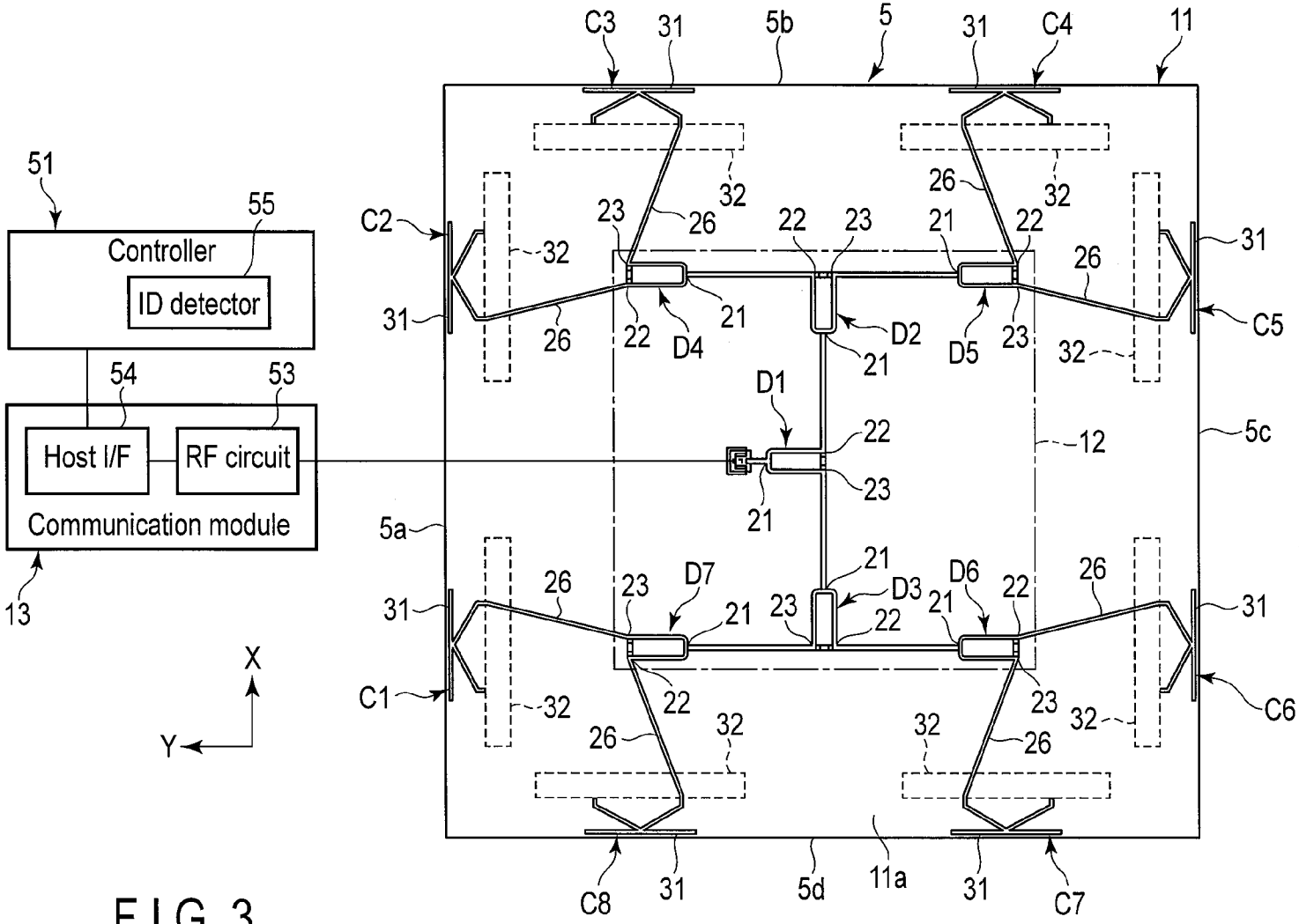
FIG. 3 is an exemplary plane view showing an antenna module shown in FIG. 2.

FIG. 3 is a plane view of the antenna module 5. The antenna module 5 comprises, for example, a printed board 11, a plurality of (for example, eight) antennas (i.e., couplers) C1 to C8 and a distributor 12. The printed board 11 is, for example, a circuit board formed into a rectangular plate-shape, and comprises a first surface 11*a* and a second surface located on a side opposite to the first surface 11*a*. The printed board 11 is provided in the communication region 6 of the housing 2 (see FIG. 2).

The outer shape of the antenna module 5 is formed by the printed board 11. The printed board 11 may be a rigid printed board (for example, an FR4 board), or may be a flexible printed board. The first to eighth antennas C1 to C8 and the distributor 12 are provided on a surface (for example, the first surface 11*a*) of the printed board 11.

The printed board 11 comprises first to fourth end portions 5*a*, 5*b*, 5*c* and 5*d*. The first end portion 5*a* extends along the first side 6*a* of the communication region 6. The second end portion 5*b* extends in a direction intersecting with (for example, substantially perpendicular to) the first end portion 5*a*. The second end portion 5*b* extends along the second side 6*b* of the communication region 6. The third end portion 5*c* is located on a side opposite to the first end portion 5*a*, and extends in substantially parallel with the first end portion 5*a*. The third end portion 5*c* extends along the third side 6*c* of the communication region 6. The fourth end portion 5*d* is located on a side opposite to the second end portion 5*b*, and extends in substantially parallel with the second end portion 5*b*. The fourth end portion 5*d* extends along the fourth side 6*d* of the communication region 6.

As shown in FIG. 2 and FIG. 3, the first antenna (i.e., first coupler) C1 is provided in the first end portion 5*a*, and is allocated in the first region S1 of the communication region 6. The second antenna (i.e., second coupler) C2 is provided in the first end portion 5*a*, and is allocated in the second region S2 of the communication region 6. The third antenna (i.e., third coupler) C3 is provided in the second end portion 5*b*, and is allocated in the third region S3 of the communication region 6. The fourth antenna (i.e., fourth coupler) C4 is provided in the second end portion 5*b*, and is allocated in the fourth region S4 of the communication region 6. The fifth antenna (i.e., fifth coupler) C5 is provided in the third end portion 5*c*, and is allocated in the fifth region S5 of the communication region 6. The sixth antenna (i.e., sixth coupler) C6 is provided in the third end portion 5*c*, and is allocated in the sixth region S6 of the communication region 6. The seventh antenna (i.e., seventh coupler) C7 is provided in the fourth end portion 5*d*, and is allocated in the seventh region S7 of the communication region 6. The eighth antenna (i.e., eighth coupler) C8 is provided in the fourth end portion 5*d*, and is allocated in the eighth region S8 of the communication region 6.

Thus, the first to eighth antennas C1 to C8 are arranged along the outer frame of the antenna module 5 at substantially regular intervals. In other words, the first antenna C1 and the first region S1 are examples of elements "first antenna" and "first region". The third antenna C3 and the third region S3 are examples of elements "second antenna" and "second region". The fifth antenna C5 and the fifth region S5 are examples of elements "third antenna" and "third region". The seventh antenna C7 and the seventh region S7 are examples of elements "fourth antenna" and "fourth region".

The first to eighth antennas C1 to C8 are formed by, for example, a wiring pattern provided on the surface (for example, the first surface 11*a*) of the printed board 11, and are located on substantially the same plane surface. A part or all of the first to eighth antennas C1 to C8 may be provided in a member different from the printed board 11.

Next, the distributor 12 of the antenna module 5 is explained.

The distributor (i.e., antenna distributor or distribution module) 12 equally distributes one electric signal (i.e., antenna signal or coupler signal) to the plurality of antennas C1 to C8, maintaining impedance matching. In the present embodiment, for example, the distributor 12 distributes the same signal to eight antennas C1 to C8. The type of the distributor 12 is, for example, a Wilkinson type. However, the distributor 12 is not limited to this example. The distributor 12 sends a signal which is input from, for example, a close proximity wireless communication module 13 (explained later) to eight antennas C1 to C8. The distributor 12 sends a signal which is received by at least one of antennas C1 to C8 to the communication module 13.

Specifically, the distributor 12 comprises first to seventh distribution elements D1 to D7. The first to seventh distribution elements D1 to D7 have substantially the same structure and function. Therefore, the first distribution element D1 is explained in detail as the representative example.

Figure 4:
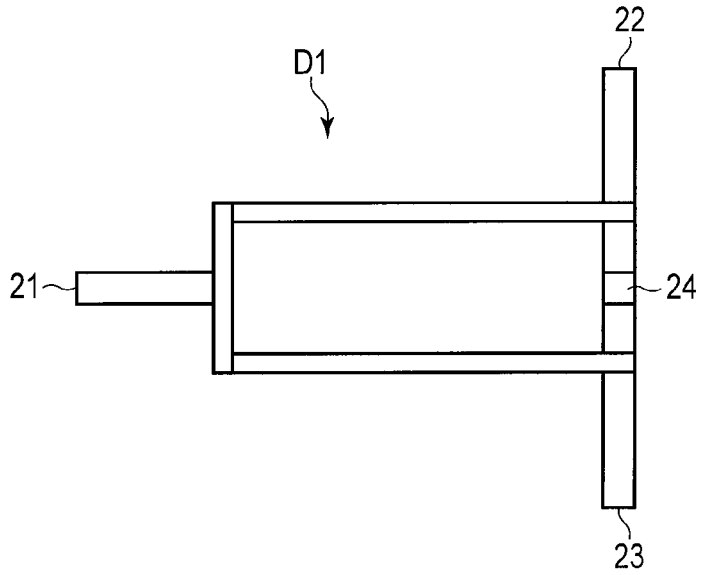
FIG. 4 is an exemplary plane view showing a part of a distributor shown in FIG. 3.

FIG. 4 shows the first distribution element (i.e., first distributor) D1. The first distribution element D1 comprises a first terminal 21, a second terminal 22 and a third terminal 23. The second terminal 22 and the third terminal 23 are electrically connected to the first terminal 21 in parallel. Between the second terminal 22 and the third terminal 23, a resistor 24 for maintaining impedance matching is provided. Thus, a signal which is input in the first terminal 21 is equally distributed and output to the second terminal 22 and the third terminal 23. A signal which is input in one of the second terminal 22 and the third terminal 23 is output from the first terminal 21. Each of the second to seventh distribution elements D2 to D7 comprises the first terminal 21, the second terminal 22 and the third terminal 23 in the same manner as the first distribution element D1.

As shown in FIG. 3, the first distribution element D1 is located at the uppermost stream when viewed from the communication module 13. The communication module 13 is electrically connected to the first terminal 21 of the first distribution element D1. The first terminal 21 of the second distribution element (i.e., second distributor) D2 is connected to the second terminal 22 of the first distribution element D1. The first terminal 21 of the third distribution element (i.e., third distributor) D3 is connected to the third terminal 23 of the first distribution element D1.

In this manner, the first terminal 21 of the fourth distribution element (i.e., fourth distributor) D4 is connected to the second terminal 22 of the second distribution element D2. The second antenna C2 is connected to the second terminal 22 of the fourth distribution element D4. The third antenna C3 is connected to the third terminal 23 of the fourth distribution element D4.

The first terminal 21 of the fifth distribution element (i.e., fifth distributor) D5 is connected to the third terminal 23 of the second distribution element D2. The fourth antenna C4 is connected to the second terminal 22 of the fifth distribution element D5. The fifth antenna C5 is connected to the third terminal 23 of the fifth distribution element D5.

The first terminal 21 of the sixth distribution element (i.e., sixth distributor) D6 is connected to the second terminal 22 of the third distribution element D3. The sixth antenna C6 is connected to the second terminal 22 of the sixth distribution element D6. The seventh antenna C7 is connected to the third terminal 23 of the sixth distribution element D6.

The first terminal 21 of the seventh distribution element (i.e., seventh distributor) D7 is connected to the third terminal 23 of the third distribution element D3. The eighth antenna C8 is connected to the second terminal 22 of the seventh distribution element D7. The first antenna C1 is connected to the third terminal 23 of the seventh distribution element D7. These structures form an example of the distributor 12.

In the present embodiment, the distribution elements D1 to D7 are electrically connected to each other and to antennas C1 to C8 via a wiring pattern 26 of the printed board 11. The wiring pattern 26 may be provided in a surface layer (i.e., the first surface 11*a* or the second surface) of the printed board 11, or in an inner layer. FIG. 3 shows an example of the wiring pattern 26 provided on the first surface 11*a* of the printed board 11. A cable may be used for one or all of the electrical connections between the distribution elements D1 to D7 and between the distribution elements D1 to D7 and antennas C1 to C8.

[Antenna (Coupler) Structures]

Next, this specification explains antenna structures. Eight antennas C1 to C8 are provided on the first surface 11*a* of the printed board 11. The eight antennas C1 to C8 have substantially the same shape and function. Therefore, the first antenna C1 (hereinafter, referred to as antenna C1) is explained in detail.

Figure 5:
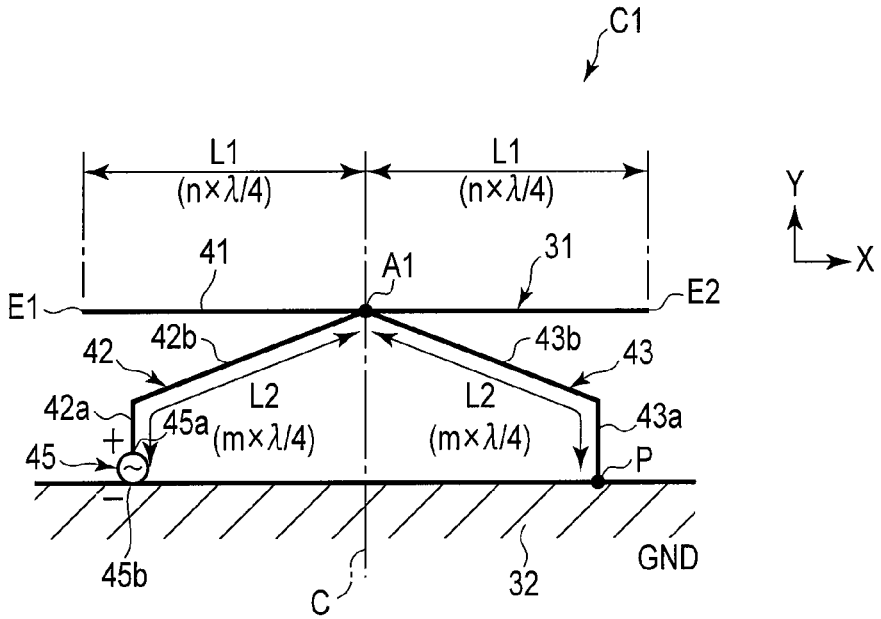
FIG. 5 schematically shows an example of an antenna shown in FIG. 3.
Figure 6:
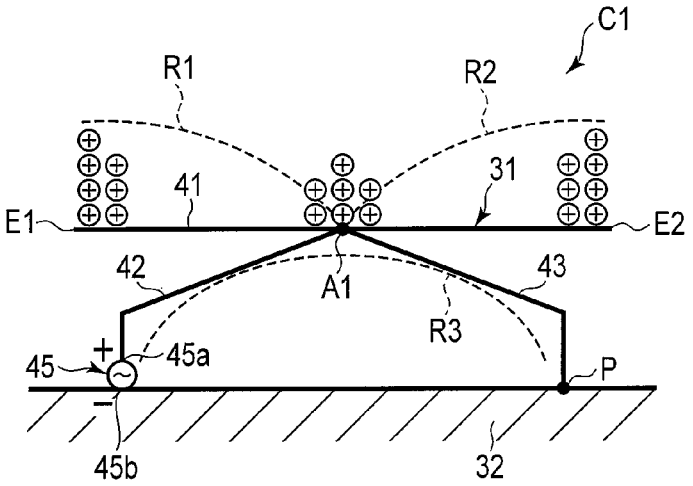
FIG. 6 schematically shows an example of resonance of the antenna shown in FIG. 3.
Figure 7:
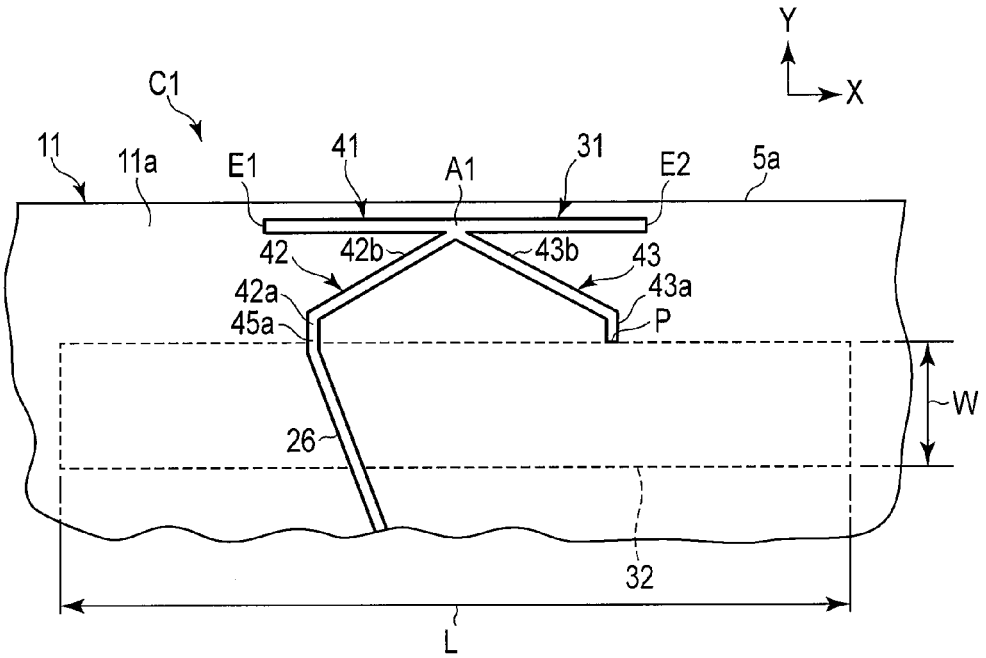
FIG. 7 is an exemplary plane view showing a mounting structure of the antenna shown in FIG. 3.

FIG. 5 to FIG. 7 show antenna (i.e., coupler) C1 according to the present embodiment. In the present embodiment, antenna C1 receives and transmits data by electromagnetic coupling (i.e., electrostatic field [quasi-electrostatic field] or induced electric field coupling) between antenna C1 and another antenna. Antenna C1 is an antenna (i.e., coupler) used for close proximity wireless communication (i.e., near field wireless communication). In close proximity wireless communication, data is transferred between devices which are close to each other. The scheme of close proximity wireless communication is, for example, TransferJet (registered trademark). However, the scheme is not limited to this example. TransferJet is an example of the close proximity wireless communication scheme using ultra-wideband (UWB). When two devices approach within a communication range (for example, 3 cm), the antennas of the devices are electromagnetically coupled to each other. This coupling allows the devices to perform peer-to-peer wireless communication.

FIG. 5 schematically shows a structural example of antenna C1. Antenna C1 comprises an antenna pattern 31 and a ground 32. The antenna pattern 31 includes a coupling element 41, a feeding element 42 and a short-circuiting element 43. Each of the elements 41, 42 and 43 is linear.

In the present embodiment, antenna C1 is formed as a plane type antenna. Antenna C1 is formed by, for example, a wiring pattern on the top surface of the printed board 11.

The coupling element (i.e., first conducting element or first conducting portion) 41 is an element configured to electromagnetically couple antenna C1 and another antenna. The coupling element 41 is, for example, a long and thin element which linearly extends in a first direction X, and comprises a first open end E1 and a second open end E2. The first open end E1 is one end of the coupling element 41. The second open end E2 is the other end of the coupling element 41. No electric conductor is connected to the first open end E1 or the second open end E2.

The coupling element 41 comprises a mid-point A1 between the first open end E1 and the second open end E2. The mid-point A1 is the mid-point between the two open ends E1 and E2 of the coupling element 41. In sum, the mid-point A1 of the coupling element 41 is the longitudinal mid-point of the coupling element 41. The distance between the first open end E1 and the mid-point A1 is equal to the distance between the second open end E2 and the mid-point A1. The mid-point A1 is an example of an element "connecting point".

As shown in FIG. 5, a feeding terminal 45 is provided between the feeding element 42 and the ground 32. The feeding terminal 45 includes a positive-side feed-point 45*a* and a ground-side feed-point 45*b*. The positive-side feed-point 45*a* is electrically connected to the distributor 12 via the wiring pattern 26 of the printed board 11. A signal is input in the positive-side feed-point 45*a* from the distributor 12. The ground-side feed-point 45*b* is electrically connected to the ground 32. The feeding terminal 45 may be a connector to which a coaxial cable configured to transmit a signal is connected.

The feeding element (i.e., second conducting element or second conducting portion) 42 is an example of an element "first connecting element". The feeding element 42 is electrically connected to the mid-point A1 of the coupling element 41 in order to supply power to the coupling element 41. A current is supplied from the positive-side feed-point 45*a* (hereinafter, referred to as the feed-point 45*a*) to the feeding element 42. The feeding element 42 connects the feed-point 45*a* and the mid-point A1 of the coupling element 41. Specifically, one end of the feeding element 42 is connected to the feed-point 45*a*. The other end of the feeding element 42 is connected to the mid-point A1 of the coupling element 41. In the present embodiment, the feeding element 42 is directly connected to the mid-point A1 of the coupling element 41.

As shown in FIG. 5, the feeding element 42 comprises a first portion 42*a* and a second portion 42*b*, and is bended between the first portion 42*a* and the second portion 42*b*. The first portion 42*a* is connected to the feed-point 45*a*. The first portion 42*a* linearly extends in a second direction Y substantially perpendicular to the first direction X. The second portion 42*b* linearly extends between the first portion 42*a* and the mid-point A1 of the coupling element 41. The second portion 42*b* extends in a direction intersecting with the first direction X and the second direction Y at a slant (in other words, in a direction intersecting with the coupling element 41 at a slant).

As shown in FIG. 5, a short-circuiting point P is located between the short-circuiting element 43 and the ground 32. The short-circuiting point P is a connecting position connecting the antenna pattern 31 to the ground 32. Here, antenna C1 comprises a center line C passing through the mid-point A1 of the coupling element 41 in the second direction Y. The feeding terminal 45 and the short-circuiting point P are separately located on both sides of the center line C of antenna C1. The distance between the feeding terminal 45 and the short-circuiting point P in the first direction X is not particularly limited, and may be set in such a way that the distance is suitable for the length of each of the feeding element 42 and the short-circuiting element 43.

The short-circuiting element (i.e., third conducting element or third conducting portion) 43 is an example of an element "second connecting element". The short-circuiting element 43 may constitute an example of the first connecting element. In this case, the feeding element 42 constitutes an example of the second connecting element.

The short-circuiting element 43 is electrically connected to the mid-point A1 of the coupling element 41. A current is supplied from the feed-point 45*a* to the short-circuiting element 43. The short-circuiting element 43 connects the mid-point A1 of the coupling element 41 and the short-circuiting point P. Specifically, one end of the short-circuiting element 43 is connected to the mid-point A1 of the coupling element 41. The other end of the short-circuiting element 43 is connected to the short-circuiting point P. In the present embodiment, the short-circuiting element 43 is directly connected to the mid-point A1 of the coupling element 41.

As shown in FIG. 5, the short-circuiting element 43 comprises a first portion 43*a* and a second portion 43*b*, and is bended between the first portion 43*a* and the second portion 43*b*. The first portion 43*a* is connected to the short-circuiting point P. The first portion 43*a* linearly extends in the second direction Y. The second portion 43*b* linearly extends between the first portion 43*a* and the mid-point A1 of the coupling element 41. The second portion 43*b* extends in the direction intersecting with the first direction X and the second direction Y at a slant (in other words, in the direction intersecting with the coupling element 41 at a slant).

Having the above structure, the antenna pattern 31 including the coupling element 41, the feeding element 42 and the short-circuiting element 43 is bilaterally symmetrical with respect to the mid-point A1 of the coupling element 41 (in other words, with respect to the center line C).

Next, the electrical length of the coupling element 41 is explained.

The electrical length between the mid-point A1 and the first open end E1 of the coupling element 41 is L1 (i.e., a first electrical length). L1 is equal to $n\times\lambda/4$, where, n is an odd number greater than or equal to one and λ is a wavelength corresponding to the frequency used for the above-described close proximity wireless communication. More specifically, λ is a wavelength corresponding to the center frequency of the frequency band used for close proximity wireless communication. In other words, the electrical length between the mid-point A1 and the first open end E1 of the coupling element 41 is an odd multiple of ¼ of a wavelength λ. If antenna C1 (the coupling element 41) should be enlarged, the value of n should be an odd number greater than or equal to three. In the present embodiment, for example, $L1=\lambda/4$.

The electrical length between the mid-point A1 and the second open end E2 of the coupling element 41 is the same as the electrical length between the mid-point A1 and the first open end E1 of the coupling element 41, and thus, is also referred to as L1.

As described above, the electrical length between the mid-point A1 and the first open end E1 of the coupling element 41 is $n\times\lambda/4$. Therefore, the element portion between the mid-point A1 and the first open end E1 of the coupling element 41 functions as a single resonant antenna portion (i.e., resonator). Since the electrical length between the mid-point A1 and the second open end E2 of the coupling element 41 is also $n\times\lambda/4$, the element portion between the mid-point A1 and the second open end E2 of the coupling element 41 functions as another single resonant antenna portion (i.e., resonator). Thus, the coupling element 41 itself functions as a resonator.

Therefore, in antenna C1, a large current corresponding to a desired frequency band signal can be supplied to the coupling element 41 without installation of an exclusive resonant circuit such as a resonant stub in addition to the coupling element 41. As a result, on an upper surface of antenna C1, the portion along the longitudinal direction of the coupling element 41, or in other words, the region surrounding the coupling element 41 (e.g., the upper region of antenna C1) functions as a coupling portion which can be coupled to another antenna. As described above, the feeding element 42 is connected to the mid-point A1 of the coupling element 41. Therefore, the charge distribution (i.e., current distribution) in the element portion between the mid-point A1 and the first open end E1 of the coupling element 41 is symmetrical with the charge distribution (current distribution) in the element portion between the mid-point A1 and the second open end E2 of the coupling element 41. Therefore, whether an antenna of a peer device (i.e., external device) approaches the element portion between the mid-point A1 and the first open end E1 of the coupling element 41 or the element portion between the mid-point A1 and the second open end E2 of the coupling element 41, in either case, the strength of the electromagnetic coupling between the antennas can be the same.

The coupling element 41 is able to function as a coupling element which electromagnetically couples antenna C1 and its peer device in, for example, the second direction Y (i.e., antenna horizontal direction), and receives and transmits data.

Next, this specification explains the electrical length of each of the feeding element 42 and the short-circuiting element 43.

In the present embodiment, L2 (i.e., a second electrical length), which is the electrical length of each of the feeding element 42 and the short-circuiting element 43, is an odd multiple of ¼ of the wavelength λ such that the region (i.e., central region) between the region surrounding the coupling element 41 and the ground 32 can be also used as a coupling portion. In short, $L2=m\times\lambda/4$, where m is an odd number greater than or equal to one. In other words, the electrical length (L2) of each of the feeding element 42 and the short-circuiting element 43 is an odd multiple of ¼ of the wavelength λ. If antenna C1 should be enlarged, the value of m should be an odd number greater than or equal to three. In the present embodiment, the electrical length of the feeding element 42 is substantially the same as that of the short-circuiting element 43. The electrical length of the feeding element 42 may be different from that of the short-circuiting element 43.

If antenna C1 should be enlarged, the length of each element of antenna C1 may be set so as to satisfy the following conditions: n is an odd number greater than or equal to three; and m is an odd number greater than or equal to three. In the present embodiment, the case where L1=λ/4 and L2=λ/4 is shown as an example.

When the electrical length (L2) of each of the feeding element 42 and the short-circuiting element 43 is an odd multiple of ¼ of the wavelength λ, each of the feeding element 42 and the short-circuiting element 43 also functions as a single resonant antenna portion (i.e., resonator). As a result, a large current is supplied to each of the feeding element 42 and the short-circuiting element 43. Therefore, on the upper surface of antenna C1, two regions along the longitudinal directions of the feeding element 42 and the short-circuiting element 43 also function as a coupling portion which can be coupled to another antenna. Therefore, the region (i.e., central region) between the coupling element 41 and the ground 32 can be also used as a coupling portion.

Here, the coupling element 41 is able to function as a coupling element which electromagnetically couples antenna C1 and its peer device in, for example, the second direction Y (i.e., antenna horizontal direction), and receives and transmits data. Further, each of the feeding element 42 and the short-circuiting element 43 is able to function as a coupling element which electromagnetically couples antenna C1 and its peer device in, for example, a third direction Z substantially perpendicular to the first direction X and the second direction Y (in other words, a direction perpendicular to the ground 32 or a direction perpendicular to the paper surface in FIG. 5), and receives and transmits data. Thus, antenna C1 can be electromagnetically coupled to the antenna of the peer device in either the second direction Y or the third direction Z.

In other words, in the present embodiment, each of the feeding element 42 of length m×λ/4 and the short-circuiting element 43 of length m×λ/4 is able to function as a resonator and a coupling portion as described above. Thus, antenna C1 comprises three coupling portions. Therefore, the device in which antenna C1 is mounted can be easily coupled to another device.

Next, the charge distribution of antenna C1 in the present embodiment is explained with reference to FIG. 6.

As stated above, the feeding element 42 is connected to the mid-point A1 of the coupling element 41. Therefore, resonance R1 is produced in the element portion between the mid-point A1 and the first open end E1 of the coupling element 41. Charge is larger toward the first open end E1. Similarly, resonance R2 is produced in the element portion between the mid-point A1 and the second open end E2 of the coupling element 41. Charge is larger toward the second open end E2. Therefore, when only the charge distribution based on the coupling element 41 is viewed, the mid-point of the coupling element 41 is a null point.

In the feeding element 42 and the short-circuiting element 43, resonance R3 is produced. Therefore, the charge based on the resonance of the feeding element 42 and the short-circuiting element 43 mostly remains near the mid-point A1 of the coupling element 41, and complements the null point. With this structure, wherever an antenna of a peer device faces in the longitudinal direction of the coupling element 41, relatively-stable coupling can be expected.

As shown in FIG. 5, the feeding element 42 and the short-circuiting element 43 comprise the first portions 42*a* and 43*a* extending in the second direction Y respectively, and the second portions 42*b* and 43*b* extending in the direction intersecting with the coupling element 41 at a slant respectively. With this structure, for example, even if the orientation of the longitudinal direction of a coupling element of an antenna of a peer device deviates from the longitudinal direction (first direction X) of the coupling element 41 of antenna C1, these antennas can be easily coupled.

In the present embodiment, the feeding element 42 and the short-circuiting element 43 include the first portions 42*a* and 43*a* respectively and the second portions 42*b* and 43*b* respectively. The first portions 42*a* and 43*a* extend in directions different from the second portions 42*b* and 43*b*. According to this structure, it is possible to support various orientations of a coupling element of an antenna of a device facing the upper surface of antenna C1.

In the first direction X, the feed-point 45*a* may not be located immediately beneath the mid-point A1 of the coupling element 41, and may be located between the mid-point A1 and the first open end E1. Thus, the position of the feed-point 45*a* in the first direction X can be set as a position offset from the position immediately beneath the mid-point A1 of the coupling element 41. Similarly, in the first direction X, the short-circuiting point P may not be located immediately beneath the mid-point A1 of the coupling element 41, and may be located between the mid-point A1 and the second open end E2. Thus, the position of the short-circuiting point P in the first direction X can be set as a position offset from the position immediately beneath the mid-point A1 of the coupling element 41. In this structure, even if the electrical length (L2) of each of the feeding element 42 and the short-circuiting element 43 is elongated, excessive increase in the size in the width direction of antenna C1 can be prevented.

In the coupling element 41, the greater L1 is than λ/4, the more easily a signal attenuates. That is, although the space region capable of coupling the coupling element 41 and another antenna is widened the greater L1 is than λ/4, the electrical field strength around the coupling element 41 is likely to decrease.

However, in the present embodiment, as described above, in addition to the coupling element 41, the feeding element 42 and the short-circuiting element 43 function as a resonator. Therefore, sufficient electrical field strength can be obtained by the functions of these elements.

Next, this specification explains an example of a mounting structure of antenna C1 with reference to FIG. 7.

In the present embodiment, the coupling element 41, the feeding element 42, the short-circuiting element 43 and the feed-point 45*a* are formed by the wiring pattern provided on the first surface 11*a* of the printed board 11, and are located on substantially the same plane surface.

To be "located on substantially the same plane surface" means that the components are not provided away from the surface of the printed board 11. That is, the expression of "located on substantially the same plane surface" includes a case where the coupling element 41, the feeding element 42, the short-circuiting element 43 and the feed-point 45*a* are provided separately on the first surface 11*a* and the second surface of the printed board 11.

As shown in FIG. 7, in the present embodiment, the thickness (i.e., width) of each of the feeding element 42 and the short-circuiting element 43 is substantially the same as that of the coupling element 41. This structure enables the feeding element 42 and the short-circuiting element 43 to perform stable coupling to an antenna of a peer device.

In the present embodiment, the ground (i.e., ground plate) 32 is provided on the second surface of the printed board 11. The short-circuiting point P comprises a via (e.g., through-hole) configured to electrically connect the short-circuiting element 43 to the ground 32. The ground 32 may be provided on the first surface 11*a* of the printed board 11.

The ground 32 is formed into, for example, a plate-shape extending in the first direction X. The ground 32 has a length L in the first direction X (e.g., the direction substantially parallel to the coupling element 41), and a width W in the second direction Y (e.g., the direction substantially perpendicular to the coupling element 41). The length L (i.e., electrical length) of the ground 32 is an odd multiple of ¼ of the wavelength λ. The ground 32 can further strengthen the resonance of antenna C1.

The width W (i.e., electrical length) of the ground 32 is equal to ¼ of the wavelength λ. The size of the ground 32 is not limited to this example. The width W of the ground 32 may be, for example, less than ¼ of the wavelength λ. The ground 32 can inhibit the resonance of antenna C1 from weakening. The ground 32 may be electrically connected to the ground of the printed board 11.

Next, this specification explains how to arrange the plurality of antennas C1 to C8.

As shown in FIG. 3, the first antenna C1, the third antenna C3 and the fifth antenna C5 face directions different from each other. The coupling element 41 of the first antenna C1 extends in the first direction X. The coupling element 41 of the third antenna C3 extends in the second direction Y intersecting with (for example, substantially perpendicular to) the first direction X. The coupling element 41 of the fifth antenna C5 extends in the first direction X. In other words, the antenna C3 comprising the coupling element 41 extending in the second direction Y is provided between two antennas C1 and C5 each comprising the coupling element 41 extending in the first direction X. According to this structure, even if the orientation of an antenna of an external device is not suitable for coupling to an antenna which is close to the antenna of the external device, by slightly moving the external device along the surface of the communication region 6, the antenna of the external device can be easily coupled to an antenna which is provided in the communication region 6 and is suitable for the orientation of the antenna of the external device.

[Controller and Communication Module]

Next, a controller 51 and the close proximity wireless communication module 13 are explained in detail.

As shown in FIG. 3, the electronic device 1 comprises the controller 51 and the communication module 13. The controller 51 controls the electronic device 1 as a whole, and controls the communication module 13. The controller 51 comprises, for example, one or more than one IC chip including a CPU.

The communication module 13 includes a high-frequency circuit (RF circuit) 53 and a host interface (host I/F) 54. The communication module 13 performs close proximity wireless communication by using the antenna module 5, based on a signal from the controller 51. When an antenna of an external device approaches one of the first to eighth regions S1 to S8 of the communication region 6, the communication module 13 performs close proximity wireless communication by using one of the first to eighth antennas C1 to C8 located in said one of the first to eighth regions S1 to S8. For example, when an antenna of an external device approaches the first region S1 of the communication region 6, the communication module 13 performs close proximity wireless communication by using the first antenna C1. When an antenna of an external device approaches the second region S2 of the communication region 6, the communication module 13 performs close proximity wireless communication by using the second antenna C2. When an antenna of an external device approaches the third region S3 of the communication region 6, the communication module 13 performs close proximity wireless communication by using the third antenna C3.

Specifically, the communication module 13 sends the same signal to all of the first to eighth antennas C1 to C8 through the distributor 12. When an external device is put close to the communication region 6, an antenna of the external device is electromagnetically coupled to the closest one of antennas C1 to C8 to the antenna of the external device. In this manner, communication is performed between the antenna module 5 and the external device.

The controller 51 in the present embodiment stops output to the communication module 13 when the communication between the antenna module 5 and the external device is cut beyond a predetermined time. In other words, the controller 51 continues output to the communication module 13 even if the communication between the antenna module 5 and the external device is cut within the predetermined time.

According to the above structure, for example, even if an external device communicating with the first antenna C1 is moved within the communication region 6 to the vicinity of the second antenna C2, the communication between the external device and the antenna module 5 can be maintained. Thus, communication can be performed between the external device and the antenna module 5 while, for example, the external device is moved within the communication region 6.

The controller 51 may comprise an ID detector 55 configured to recognize the ID of an external device communicating with the antenna module 5. The controller 51 detects the ID of a first external device when one of the first to eighth antennas C1 to C8 begins communication with the first external device. If, while one of the first to eighth antennas C1 to C8 communicates with the first external device, a second external device approaches another one of antennas C1 to C8, the communication module 51 detects the ID of the second external device.

The controller 51 may send a predetermined signal when the ID of the second external device is detected. The predetermined signal may include content indicating that communication is currently performed with another device and content instructing standby. Instead of the above, the controller 51 may simultaneously send the same content to a plurality of external devices put close to the first to eighth antennas C1 to C8.

The above structure enables improvement of convenience of the electronic device 1. In the present embodiment, the electronic device 1 comprises the housing 2, the first antenna C1, the second antenna C2, the distributor 12 and the communication module 13. The housing 2 includes the first region S1 and the second region S2. The first antenna C1 is provided in the first region S1 of the housing 2. The second antenna C2 is provided in the second region S2 of the housing 2. The distributor 12 distributes the same signal to the first antenna C1 and the second antenna C2. The communication module 13 is electrically connected to the distributor 12. The communication module 13 performs close proximity wireless communication by using the first antenna C1 when an antenna of an external device approaches the first region S1. The communication module 13 performs close proximity wireless communication by using the second antenna C2 when an antenna of an external device approaches the second region S2.

According to this structure, it is possible to provide the electronic device 1 which can communicate with an external device wherever an antenna of the external device approaches in the plurality of regions of the communication region 6. Thus, restrictions on the position or orientation of an external device put close to the electronic device 1 can be relaxed. This enables enhancement of convenience. In particular, in the present embodiment, use of the distributor 12 eliminates the necessity of a communication module for each antenna. Therefore, it is also possible to reduce the size and manufacturing cost of the electronic device 1.

In the present embodiment, the first antenna C1, the second antenna C2 and the distributor 12 are provided on the printed board 11. The wiring pattern 26 of the printed board 11 connects the distributor 12 and each of the first antenna C1 and the second antenna C2. This structure enables further reduction in the thickness and manufacturing cost of the electronic device 1.

The present embodiment further comprises the third antenna C3 provided in the third region S3 of the communication region 6. The distributor 12 distributes the same signal as the first antenna C1 and the second antenna C2 to the third antenna C3. The communication module 13 performs close proximity wireless communication by using the third antenna C3 when an antenna of an external device approaches the third region S3. According to this structure, restrictions on the position or orientation of an external device put close to the electronic device 1 can be further relaxed, and thus, the convenience of the electronic device 1 can be further enhanced.

In the present embodiment, the printed board 11 comprises the first end portion 5*a* and the second end portion 5*b* intersecting with the first end portion 5*a*. The first antenna C1 is provided in the first end portion 5*a* of the printed board 11. The second antenna C2 is provided in the second end portion 5*b* of the printed board 11. According to this structure, two antennas C1 and C3 are provided separately in the first end portion 5*a* and the second end portion 5*b* which extend in directions different from each other on the printed board 11. Thus, the misalignment in the orientation or position of an antenna of an external device can be easily accepted.

In the present embodiment, the printed board 11 comprises the third end portion 5*c* located on the side opposite to the first end portion 5*a*. The third antenna C3 is provided in the third end portion 5*c* of the printed board 11. According to this structure, the misalignment in the orientation or position of an antenna of an external device is further acceptable.

Hereinafter, this specification explains an electronic device 1 according to second to sixth embodiments. Structures having the same or similar functions as/to those of the first embodiment will be denoted by the same reference numbers. Explanations of such structures will be omitted. Structures which are not explained below are identical with the first embodiment.

(Second Embodiment)

Figure 8:
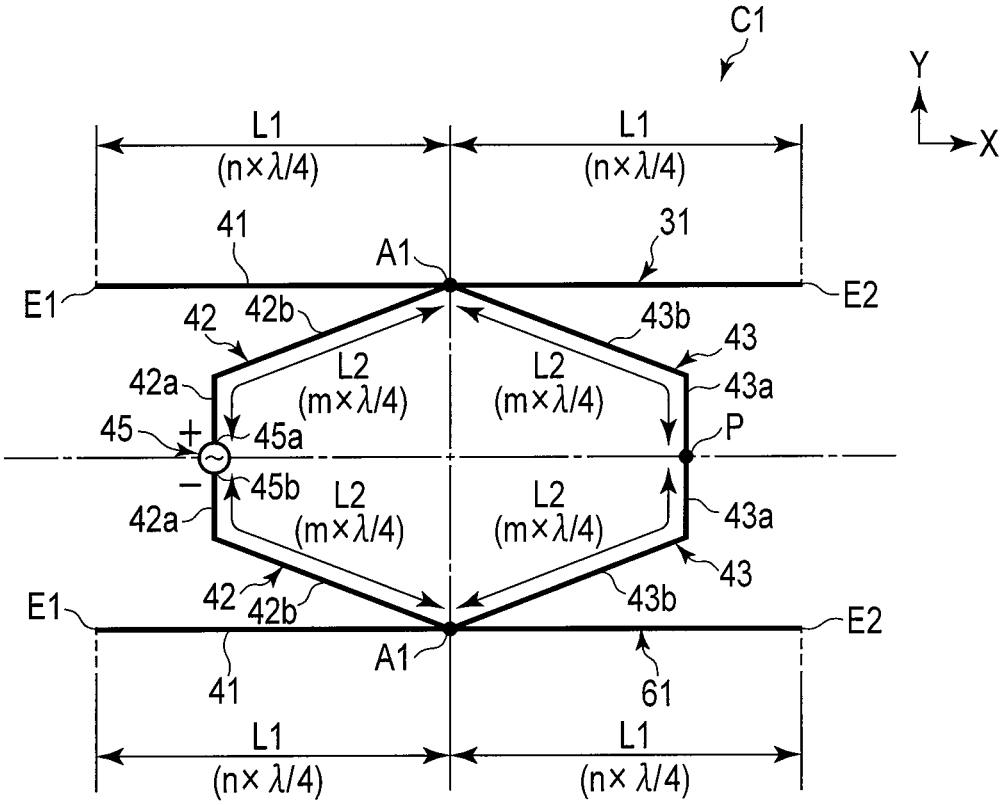
FIG. 8 schematically shows an example of an antenna according to a second embodiment.
Figure 9:
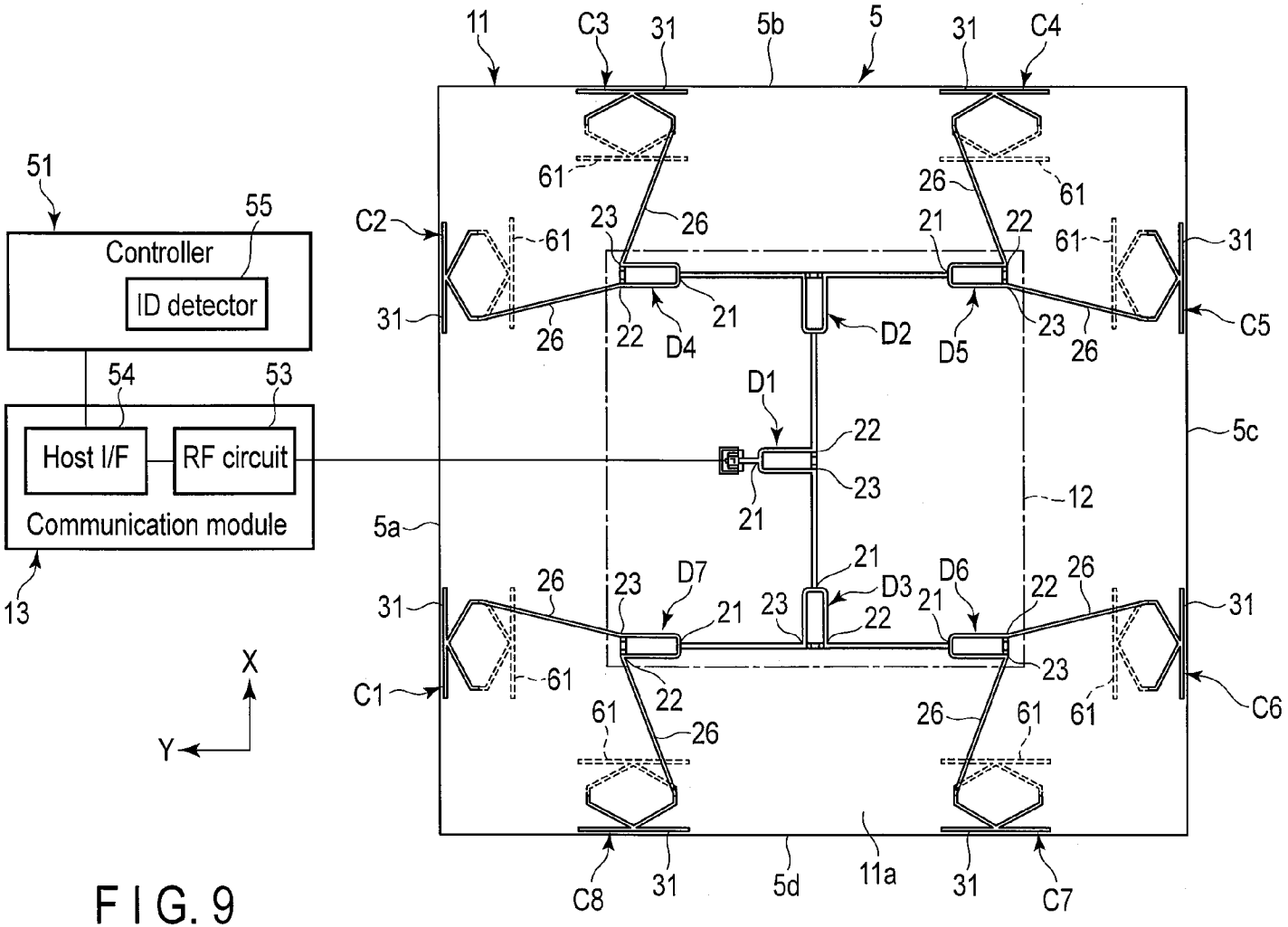
FIG. 9 is an exemplary plane view showing an antenna module according to the second embodiment.

FIG. 8 and FIG. 9 show antennas C1 to C8 of an electronic device 1 according to a second embodiment. In the present embodiment, the shape of antennas C1 to C8 is different from the first embodiment. The other structures are the same as the first embodiment.

As shown in FIG. 8 and FIG. 9, each of antennas C1 to C8 comprises a first antenna pattern 31 and a second antenna pattern 61. Each of the first antenna pattern 31 and the second antenna pattern 61 comprises a coupling element 41, a feeding element 42 and a short-circuiting element 43 in the same manner as the antenna pattern 31 of the first embodiment. The feeding element 42 of the second antenna pattern 61 is connected to a ground-side feed-point 45*b* of a feeding terminal 45. The short-circuiting element 43 of the first antenna pattern 31 is connected to the short-circuiting element 43 of the second antenna pattern 61 by a connecting point P. The second antenna pattern 61 is, for example, formed on a second surface of a printed board 11.

In the second antenna pattern 61, the electrical length (L1) between a mid-point A1 and a first open end E1 of the coupling element 41 is an odd multiple of ¼ of a wavelength λ. The electrical length (L1) between the mid-point A1 and a second open end E2 of the coupling element 41 is an odd multiple of ¼ of the wavelength λ. In the second antenna pattern 61, the electrical length (L2) of each of the feeding element 42 and the short-circuiting element 43 is equal to an odd multiple of ¼ of the wavelength λ.

According to this structure, similarly to the first embodiment, it is possible to provide the electronic device 1 in which convenience is improved. Further, according to the structure of the present embodiment, the coupling element 41, the feeding element 42 and the short-circuiting element 43 in the second antenna pattern 61 can also function as a coupling portion. Such a structure realizes antennas C1 to C8 which can be more easily coupled, and thus, the convenience of the electronic device 1 can be improved.

(Third Embodiment)

Figure 10:
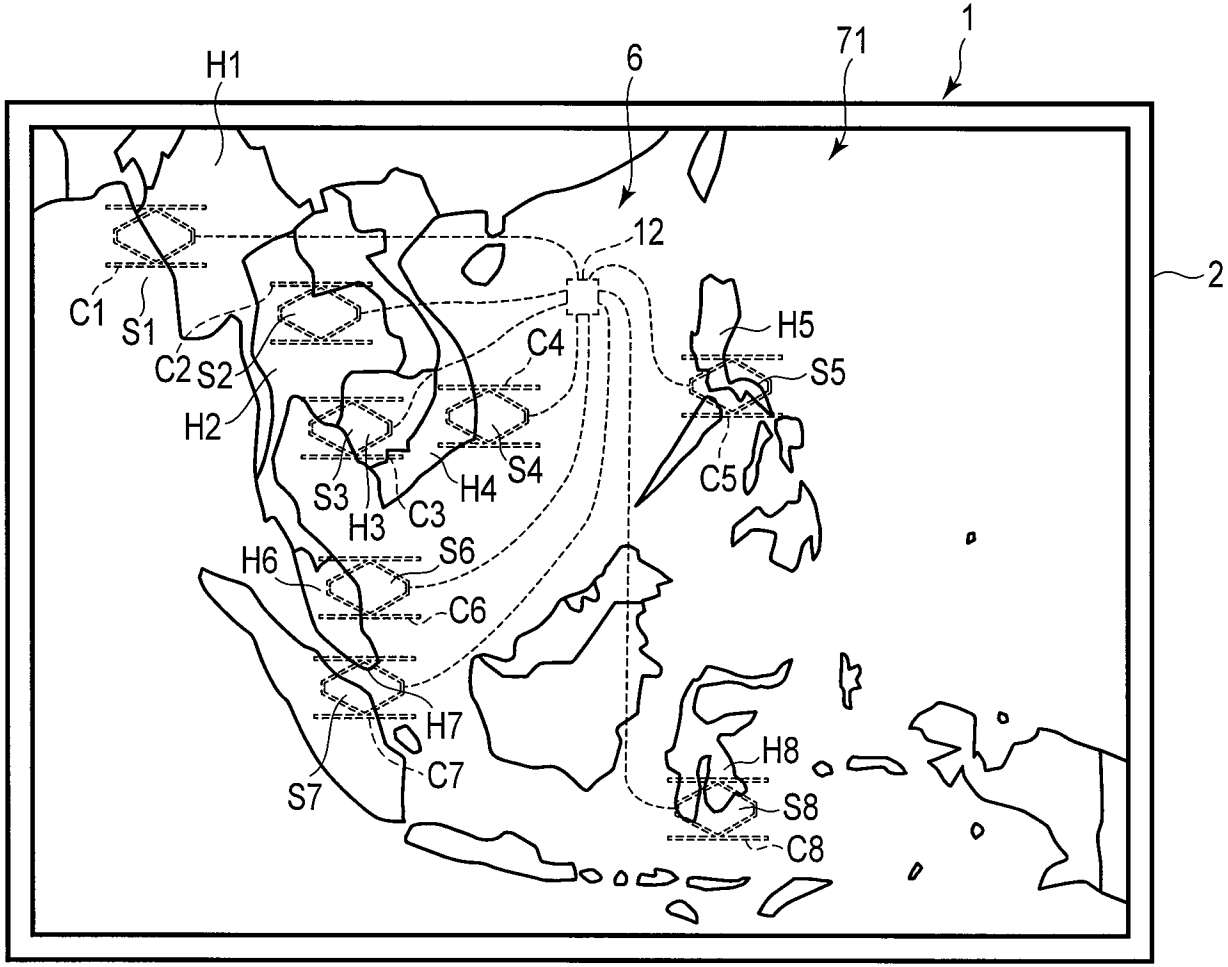
FIG. 10 is an exemplary front view showing an example of an electronic device according to a third embodiment.
Figure 11:
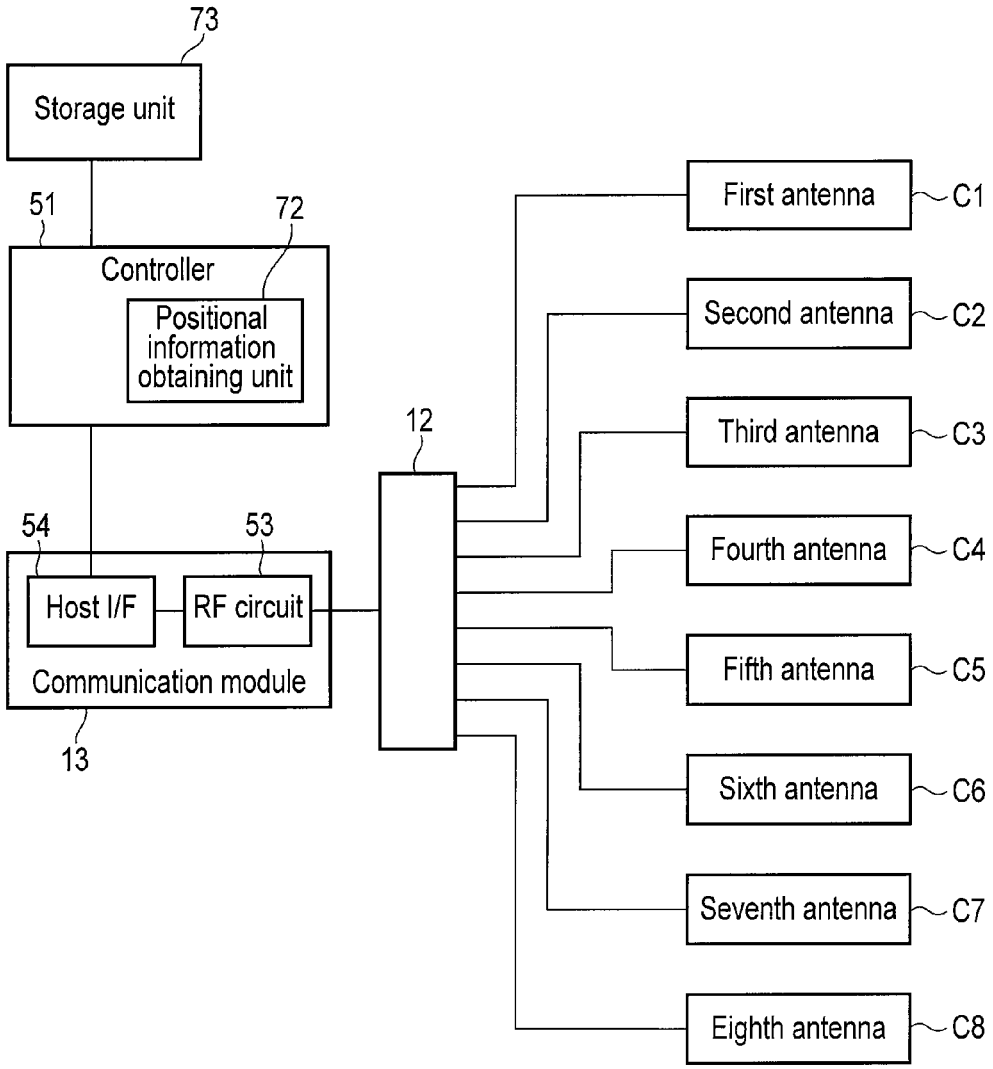
FIG. 11 shows an example of a system structure of the electronic device shown in FIG. 10.

FIG. 10 and FIG. 11 show an electronic device 1 according to a third embodiment. The electronic device 1 in the present embodiment transmits different content information depending on the position of an external device.

As shown in FIG. 10, the electronic device 1 comprises a display unit 71. The display unit 71 has, for example, an illustration and a picture. However, the display unit 71 is not limited to these examples. The display unit 71 may be formed by a display screen 3*a* of a display 3 (for example, a liquid-crystal display panel).

As shown in FIG. 11, the electronic device 1 in the present embodiment comprises a positional information obtaining unit 72. An example of the positional information obtaining unit 72 is provided in a controller 51. A positional information obtaining unit 72 obtains positional information of an external device communicating with an antenna module 5 from the external device. The positional information obtaining unit 72 detects the position of the external device based on, for example, GPS information sent from the external device.

Based on the information from the positional information obtaining unit 72, the controller 51 transmits information corresponding to the position of the external device. Based on the positional information obtained by the positional information obtaining unit 72, the controller 51 transmits first data (e.g., first information or first digital content) when the external device approaches a first region S1 (or in other words, when the positional information obtaining unit 72 determines that the external device approaches the first region S1), and the controller 51 outputs second data (e.g., second information or second digital content) which is different from the first data when the external device approaches a second region S2 (or in other words, when the positional information obtaining unit 72 determines that the external device approaches the second region S2).

As a specific example, the display unit 71 in the present embodiment has a map illustration. A communication region 6 comprises, for example, the first and second regions S1 and S2 and third to eighth regions S3 to S8 at positions corresponding to their respective countries on the map. The display unit 71 comprises first to eighth displays (e.g., first to eighth marks) H1 to H8 at positions corresponding to the first to eighth regions S1 to S8. Examples of the first to eighth displays H1 to H8 are illustrations of countries.

Behind the display unit 71, the antenna module 5 is provided. A plurality of (for example, eight) antennas C1 to C8 are provided at, for example, positions corresponding to their respective countries on the map (for example, positions behind the illustrations of countries, or in other words, positions corresponding to the first to eighth regions S1 to S8).

The controller 51 transmits content corresponding to the display of the region to which an external device is put close. Specifically, a storage unit 73 is connected to the controller 51. First to eighth data corresponding to the first to eighth displays H1 to H8 are stored in the storage unit 73. In detail, the first data includes content corresponding to the first display H1. The second data includes content corresponding to the second display H2. This explanation is also applied to the third to eighth displays H3 to H8 and the third to eighth data.

In the present embodiment, the first data includes, for example, information related to the country indicated by the first display H1. The second data includes, for example, information related to the country indicated by the second display H2. When an external device approaches the first region S1 in which the first display H1 is provided, the controller 51 sends information related to the country corresponding to the first display H1 to the external device. When an external device approaches the second region S2 in which the second display H2 is provided, the controller 51 sends information related to the country corresponding to the second display H2 to the external device.

[Modification Example of Third Embodiment]

Figure 12:
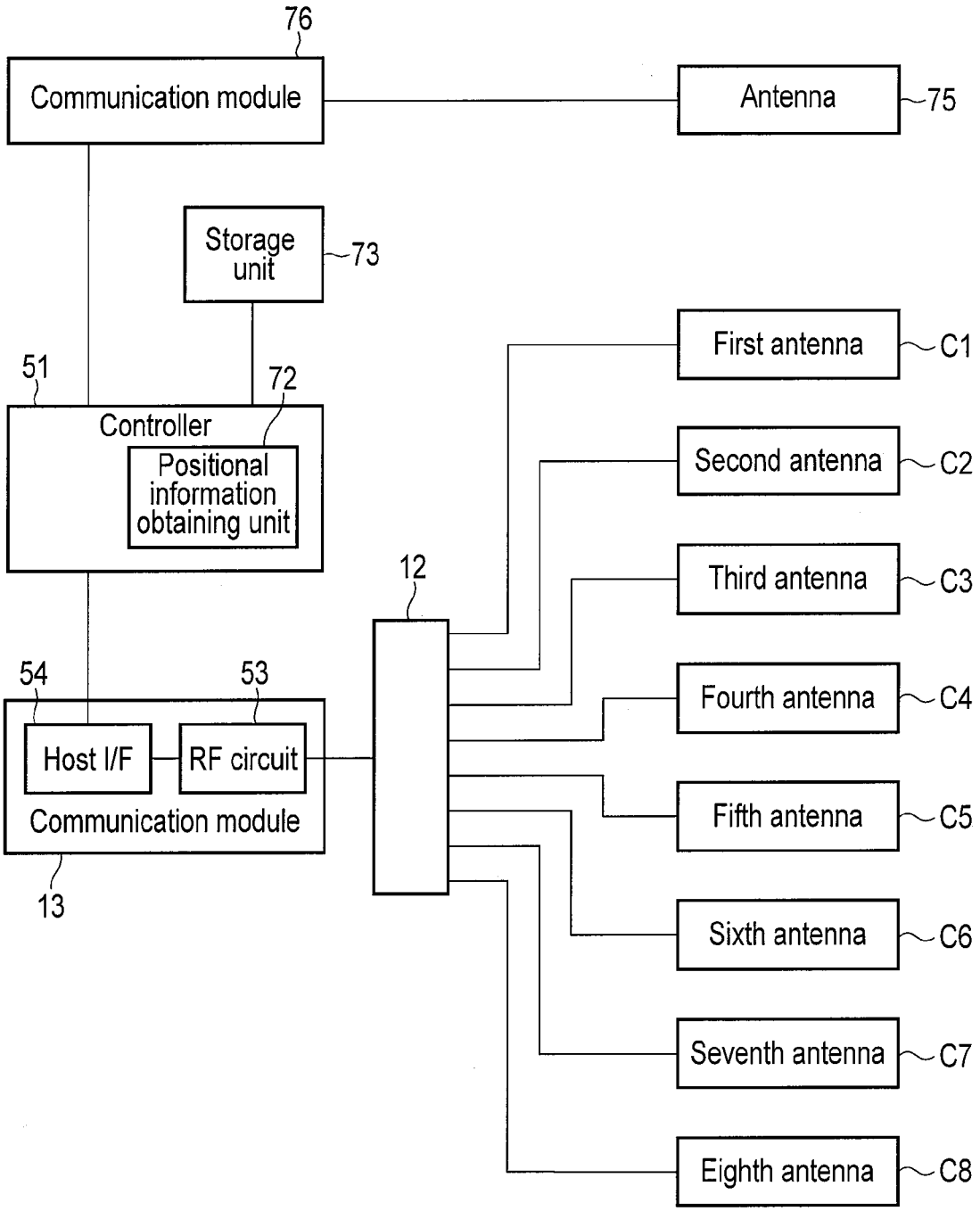
FIG. 12 shows an example of a system structure of a modification of the electronic device shown in FIG. 10.

FIG. 12 shows a modification of the electronic device 1 according to the present embodiment. As shown in FIG. 12, in the present modification example, the electronic device 1 comprises another antenna 75 and another communication module 76. The antenna 75 is, for example, an antenna for Bluetooth (registered trademark). However, the antenna 75 is not limited to this example. The antenna 75 performs wireless communication by, for example, radiating electric waves (i.e., using a radiation electromagnetic field). The communication distance of the antenna 75 is larger than the communication distance of the first to eighth antennas C1 to C8. The wireless communication module 76 performs wireless communication with an external device by using the antenna 75.

In the present modification example, based on positional information of an external device sent from the external device via the communication module 76 and the antenna 75, the positional information obtaining unit 72 detects the position of the external device. Based on information from the positional information obtaining unit 72, the controller 51 transmits information corresponding to the position of the external device. The positional information obtaining unit 72 may detect the position of the external device by a mechanical structure such as a push-button provided in the display unit 71 or another communication device such as a near-field communication (NFC) device.

According to this structure, similarly to the first embodiment, the convenience of the electronic device 1 can be enhanced. Further, according to the structure of the present embodiment, the electronic device 1 can provide different types of content information depending on the position of an external device. This structure enables further enhancement of convenience of the electronic device 1. The electronic device 1 is not limited to a device which displays a map, and is widely applicable to various devices such as a device which displays a chronological table of history.

(Fourth Embodiment)

Figure 13:
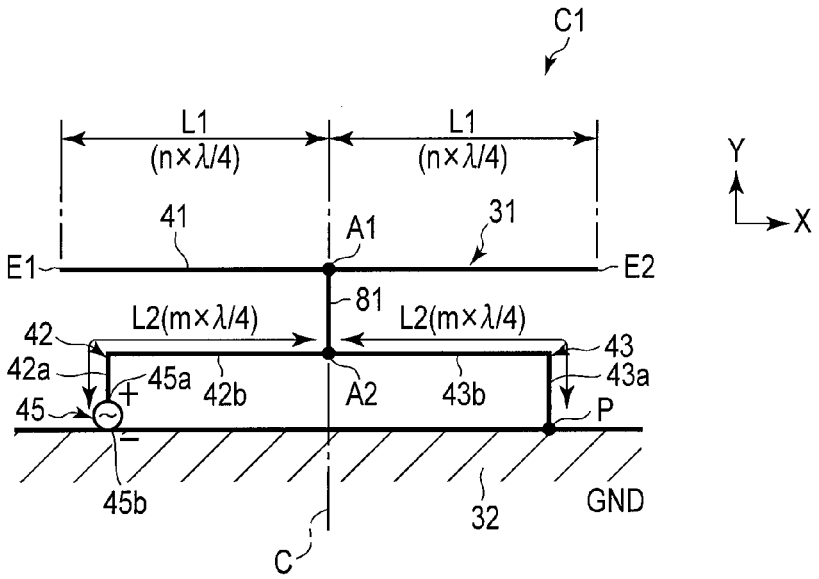
FIG. 13 schematically shows an example of an antenna according to a fourth embodiment.
Figure 14:
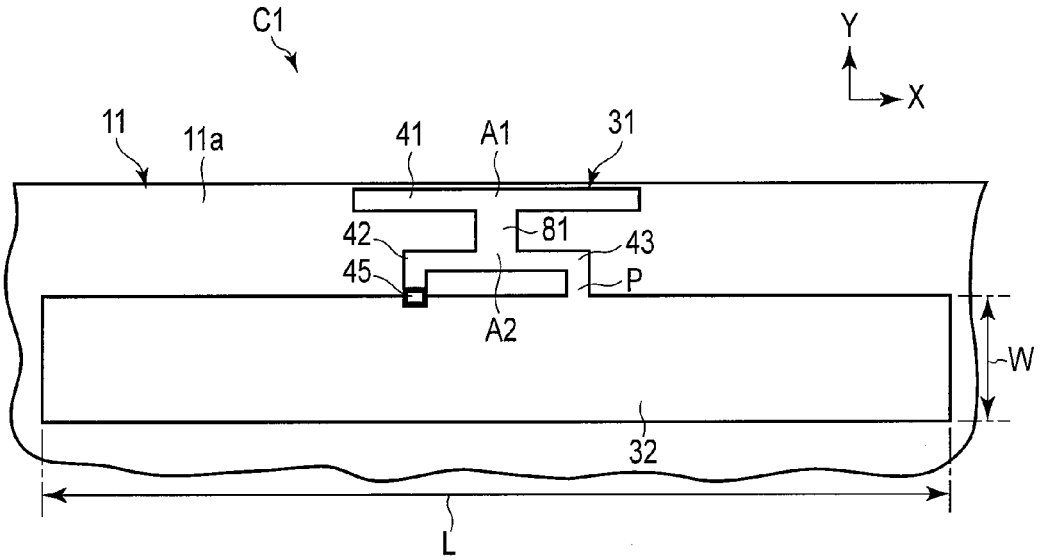
FIG. 14 is an exemplary plane view showing a mounting structure of the antenna shown in FIG. 13.

FIG. 13 and FIG. 14 show antennas C1 to C8 according to a fourth embodiment. The first to eighth antennas C1 to C8 have substantially the same shape and function. Therefore, as the representative example, the first antenna C1 is shown in FIG. 13 and FIG. 14.

In the present embodiment, neither a feeding element 42 nor a short-circuiting element 43 is directly connected to a mid-point A1 of a coupling element 41. The feeding element 42 and the short-circuiting element 43 are electrically connected to the mid-point A1 of the coupling element 41 via a connecting element 81.

Specifically, the feeding element 42 and the short-circuiting element 43 are connected to each other at a connecting point A2. The connecting element 81 extends between the connecting point A2 and the mid-point A1 of the coupling element 41, and connects the connecting point A2 and the mid-point A1. In the present embodiment, a second portion 42*b* of the feeding element 42 and a second portion 43*b* of the short-circuiting element 43 extend in a first direction X.

In the present embodiment, similarly to the first embodiment, the electrical length (L1) between the mid-point A1 and a first open end E1 of the coupling element 41 is an odd multiple of ¼ of a wavelength λ. The electrical length (L1) between the mid-point A1 and a second open end E2 of the coupling element 41 is an odd multiple of ¼ of the wavelength λ. Further, the electrical length (L2) of each of the feeding element 42 and the short-circuiting element 43 is equal to an odd multiple of ¼ of the wavelength λ.

According to this structure, similarly to the first embodiment, the convenience of an electronic device 1 can be enhanced.

(Fifth Embodiment)

Figure 15:
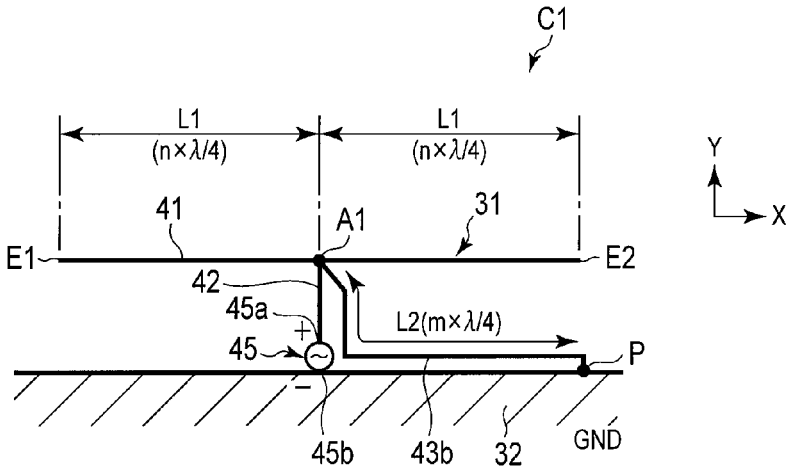
FIG. 15 schematically shows an example of an antenna according to a fifth embodiment.
Figure 16:
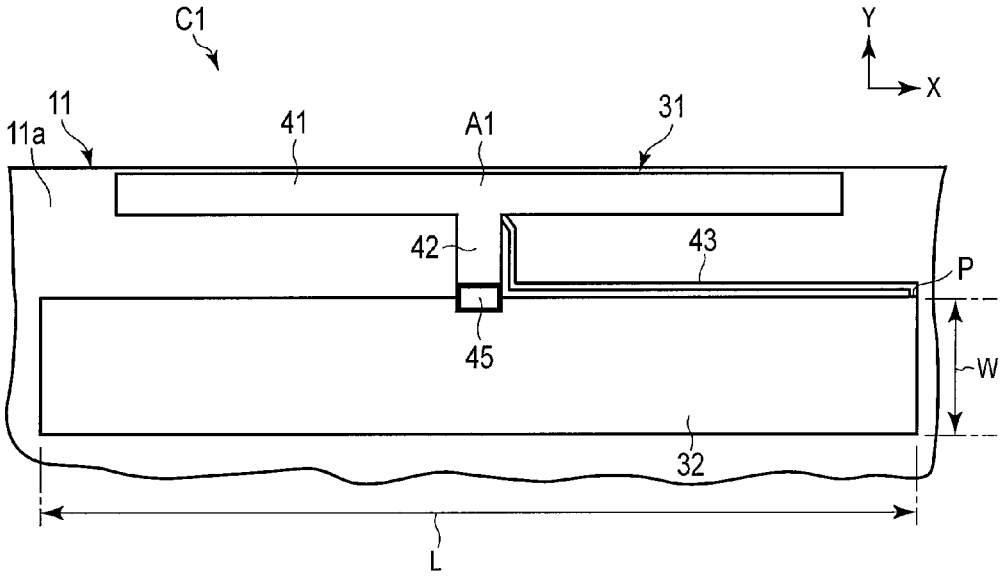
FIG. 16 is an exemplary plane view showing a mounting structure of the antenna shown in FIG. 15.

FIG. 15 and FIG. 16 show antennas C1 to C8 according to a fifth embodiment. The first to eighth antennas C1 to C8 have substantially the same shape and function. Therefore, the first antenna C1 is shown in FIG. 15 and FIG. 16 as the representative example.

In the present embodiment, a feed-point 45*a* (i.e., feeding terminal 45) is provided on a center line C of antennas C1 to C8. A feeding element 42 linearly extends from the feed-point 45*a* to a mid-point A1 of the coupling element 41, and is directly connected to the mid-point A1 of the coupling element 41. In the present embodiment, the length of the feeding element 42 is not an odd multiple of ¼ of a wavelength λ.

A short-circuiting point P is provided in an end portion of a ground 32. A short-circuiting element 43 is directly connected to the mid-point A1 of the coupling element 41, extends along edge portions of the coupling element 42 and the ground 32, and connects the mid-point A1 of the coupling element 41 and the short-circuiting point P.

In the present embodiment, similarly to the first embodiment, the electrical length (L1) between the mid-point A1 and a first open end E1 of the coupling element 41 is an odd multiple of ¼ of the wavelength λ. The electrical length (L1) between the mid-point A1 and a second open end E2 of the coupling element 41 is an odd multiple of ¼ of the wavelength λ. Further, the electrical length (L2) of the short-circuiting element 43 is equal to an odd multiple of ¼ of the wavelength λ.

According to this structure, similarly to the first embodiment, the convenience of an electronic device 1 can be improved.

[Modification Example of Fifth Embodiment]

Figure 17:
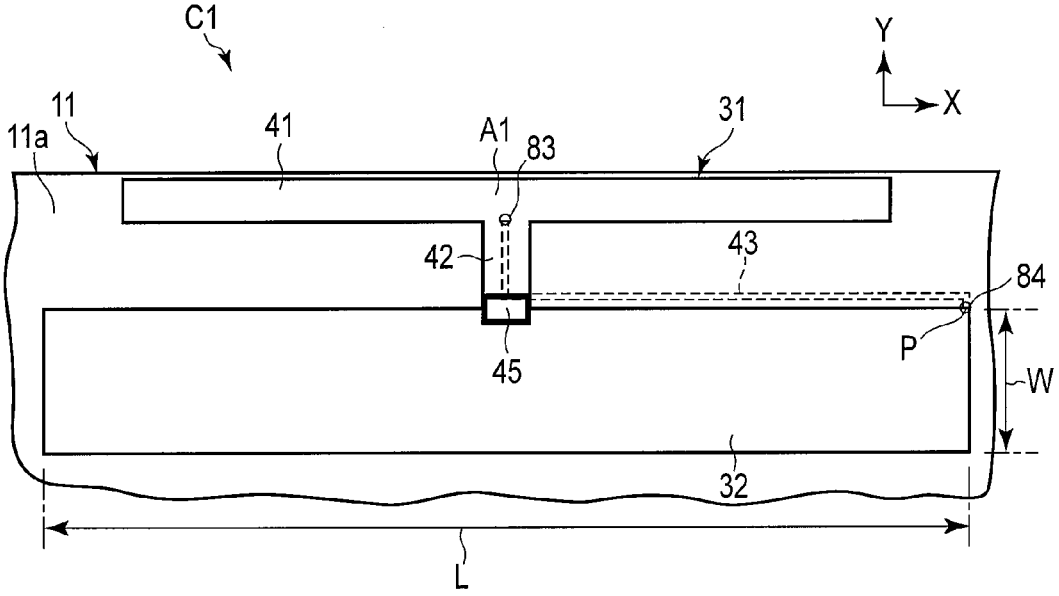
FIG. 17 is an exemplary plane view showing a mounting structure of a modification of the antenna shown in FIG. 15.
Figure 18:
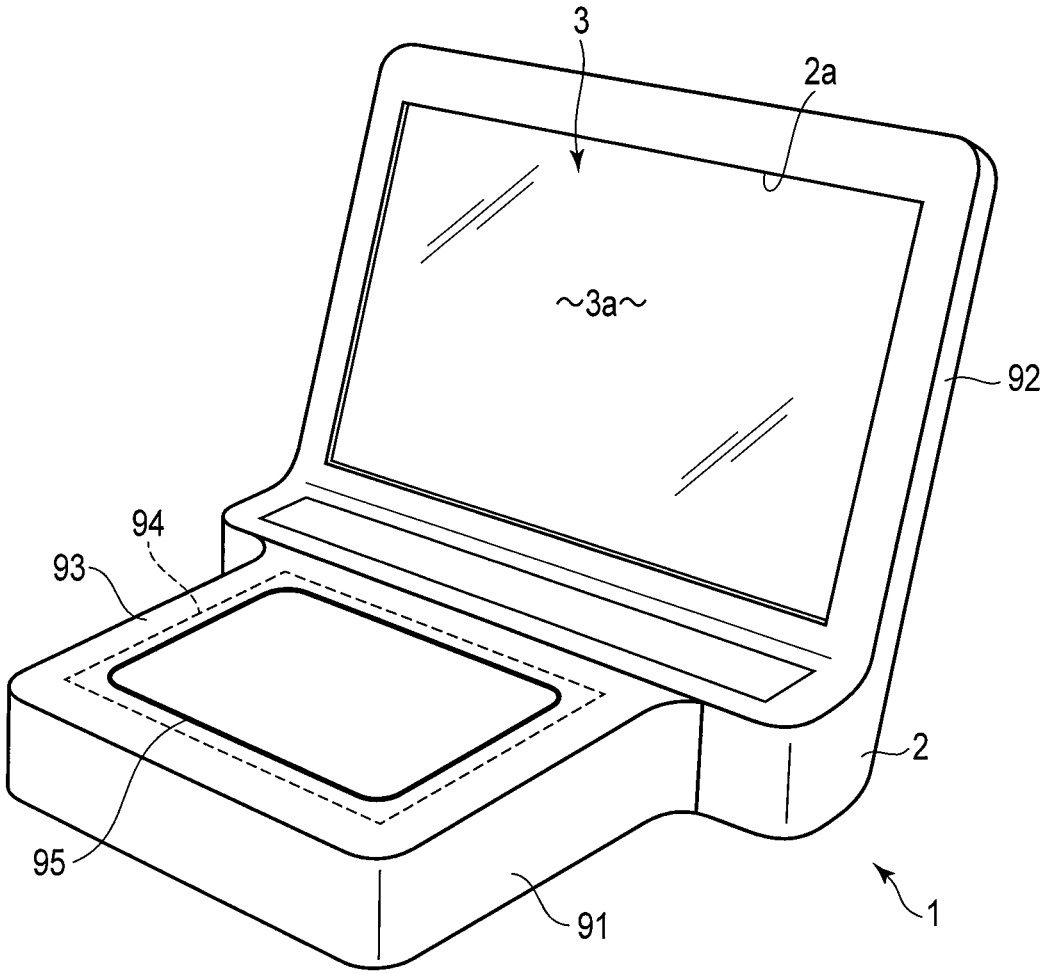
FIG. 18 is an exemplary perspective illustration showing an electronic device according to a sixth embodiment.

FIG. 17 shows a modification example of antennas C1 to C8 according to the fifth embodiment. Antennas C1 to C8 are realized by using two faces of a printed board 11. The two faces of the printed board 11 are a first surface 11*a* and a second surface. The coupling element 41, the feeding element 42 and the feeding terminal 45 are provided on the first surface 11*a* of the printed board 11.

As shown in FIG. 17, the short-circuiting element 43 is provided on the second surface of the printed board 11. One end of the short-circuiting element 43 is connected to the mid-point A1 of the coupling element 41 on the first surface 11*a* through a via (e.g., through-hole) 83. The other end of the short-circuiting element 43 is connected to the ground 32 on the first surface 11*a* through a via (e.g., through-hole) 84. This structure realizes the electronic device 1 which has the same function as the above fifth embodiment.

(Sixth Embodiment)

FIG. 18 to FIG. 21 show an electronic device 1 according to a sixth embodiment. In the present embodiment, the electronic device 1 is a device which provides a mobile device (i.e., external device) such as a smartphone with various types of services. These services are executed by using close proximity wireless communication. The electronic device 1 may be realized as, for example, a network-attached storage (NAS) incorporating a close proximity wireless communication function.

The electronic device 1 may receive digital content stored in an external device, such as a moving picture, music and an electronic book, from the external device by close proximity wireless communication. The electronic device 1 can save the digital content in the electronic device 1 as a backup file of the digital content. In addition, the electronic device 1 can transmit the digital content saved in the electronic device 1 to a smartphone, etc., by close proximity wireless communication.

Hereinafter, this specification explains the structure of the electronic device 1, presuming the case where the electronic device 1 is a wireless NAS.

The electronic device 1 may comprise a box (i.e., main unit) 91 and a display unit 92. The display unit 92 may be physically attached to the box 91. Alternatively, the display unit 92 and the box 91 may be wirelessly connected to each other by a wireless LAN (802.11a/b/g/n), etc. In the latter case, the display unit 92 and the box 91 do not always have to be close to each other, and the display unit 92 can be freely provided.

An upper surface 93 of a housing 2 of the box 91 functions as a communication surface for performing close proximity wireless communication with a mobile device (i.e., external device) such as a smartphone. The upper surface 93 is a top surface of an upper wall of the housing of the box 91. The upper surface 93 includes a region 94 in which a mobile device such as a smartphone can be placed. The region 94 functions as a communication region for performing close proximity wireless communication between a mobile device placed in the region 94 and the electronic device 1.

In the communication region 94, a plurality of (for example, two) antennas (i.e., couplers) C1 and C2 used for close proximity wireless communication are provided. In this case, antennas C1 and C2 may be provided on, for example, an inner surface of the upper wall of the housing of the box 91. Alternatively, antennas C1 and C2 may be provided on the top surface of the upper wall of the housing 2 of the box 91, and further, this top surface of the upper wall may be covered by a member such as an outer case or a covering portion.

The user is able to use a desired service such as transfer of digital content by merely placing his/her smartphone (i.e., mobile device) in the communication region 94 of the upper surface 93.

A guide 95 may be provided on the upper surface 93. The guide 95 functions as a position-determination mark for specifying where a smartphone should be placed. The guide 95 may be a frame indicating the outer shape of a normal smartphone, or may be four corner-marks for specifying the positions of four corners of the outer shape of a normal smartphone.

Figure 19:
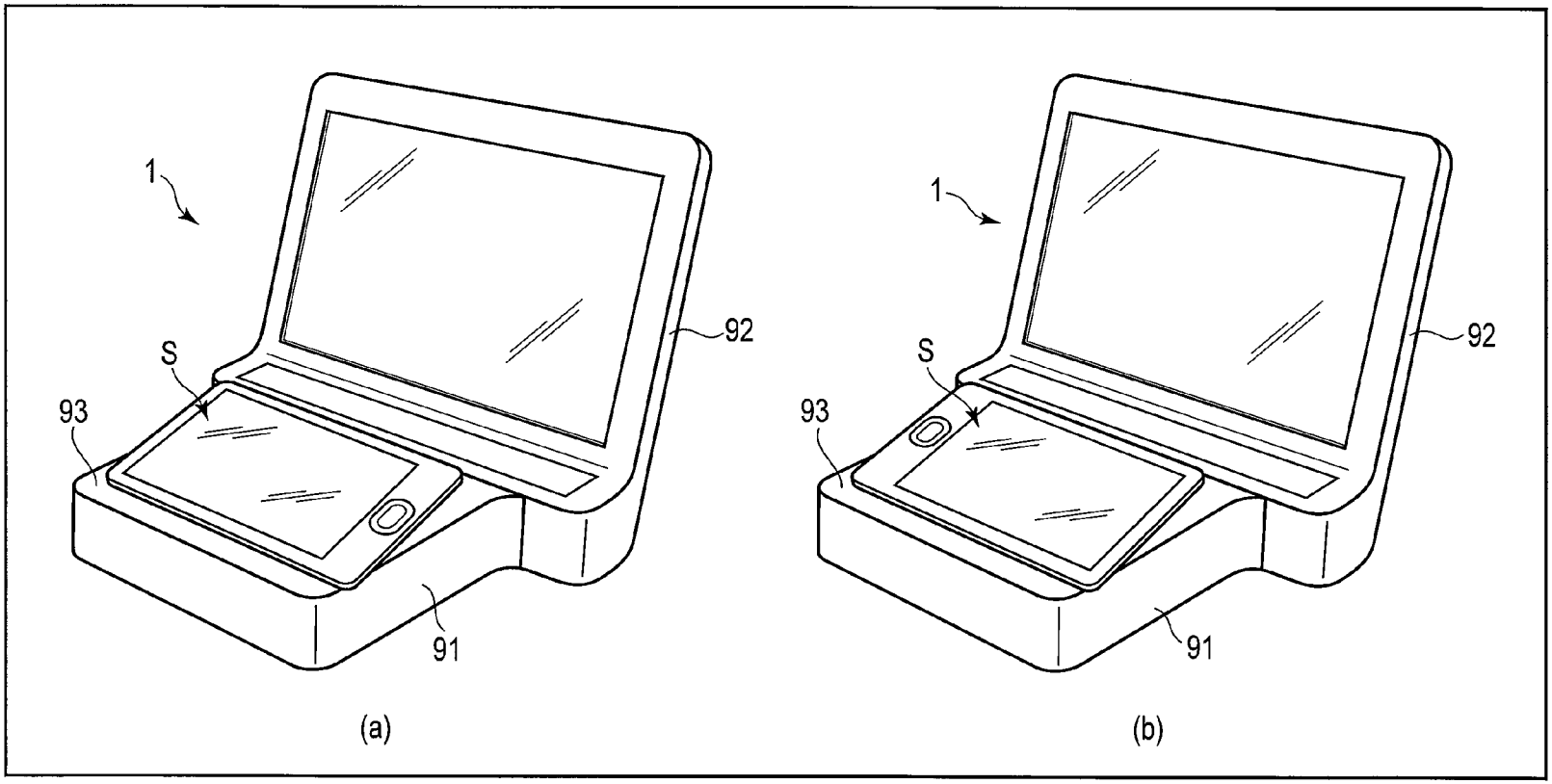
FIG. 19 is an exemplary perspective illustration showing an example of how the electronic device shown in FIG. 18 is used.

FIG. 19 shows examples of orientations of a smartphone S placed on the upper surface 93.

The frequency used for close proximity wireless communication (e.g., TransferJet) is high at 4.48 GHz. Because of this, in the smartphone S, an effect on close proximity wireless communication by the other components of the smartphone S needs to be reduced. Therefore, in some cases, an antenna (i.e., coupler) of the smartphone S is provided near an end portion (for example, an upper end portion or a lower end portion) of a housing of the smartphone S. Further, the position of the end portion in which the antenna is provided may differ depending on the type of the smartphone S.

Here, this specification presumes that an antenna (i.e., coupler) is provided in, for example, the lower end portion of the housing of the smartphone S. The specific position which the antenna of the smartphone S faces on the upper surface 93 differs between when the smartphone S is placed in the communication region 94 of the upper surface 93 as shown in FIG. 19(*a*) and when the smartphone S is placed in the communication region 94 of the upper surface 93 as shown in FIG. 19(*b*). Therefore, when antennas are provided on the upper surface 93 of the box 91, it is necessary to arrange the antennas in such a way that the smartphone S can perform stable data communication with the box 91 regardless of the orientation of the smartphone S placed on the upper surface 93.

Figure 20:
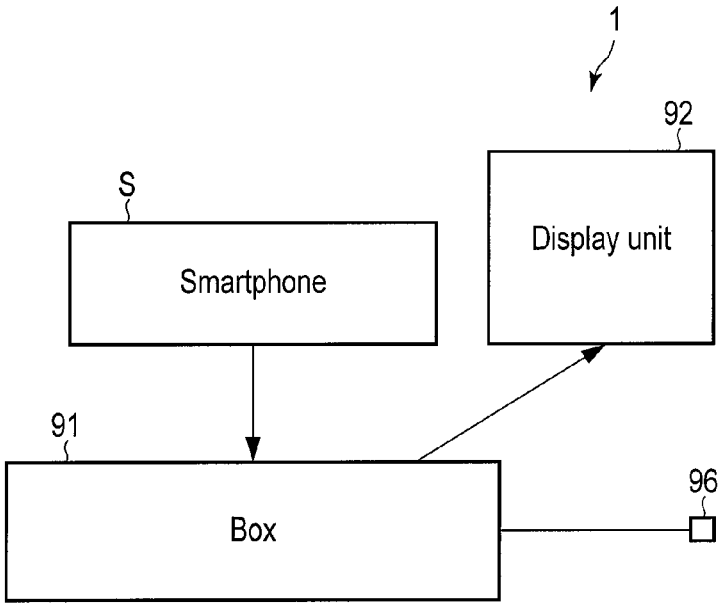
FIG. 20 shows an example of a system structure of the electronic device shown in FIG. 18.

Next, this specification explains operations of the box 91 in the electronic device 1 with reference to FIG. 20.

For example, the box 91 is connected to a network via a LAN cable or optical cable connected to a connector 96. The box 91 can store, in a storage device of the box 91, various types of digital content received via the network. The box 91 can also transmit information indicating a list of digital content types (for example, a list of content names) stored in the storage device to the display unit 92.

When the smartphone S is placed on the upper surface 93 of the box 91, close proximity wireless communication is begun between the box 91 and the smartphone S. For example, digital content which is not stored in the box 91 is automatically transferred from the smartphone S to the box 91 by close proximity wireless communication. The digital content is stored in the storage device of the box 91. By selecting arbitrary digital content from a list of content names in the box 91 displayed in the display unit 92, the user can store the selected digital content in smartphone S.

Figure 21:
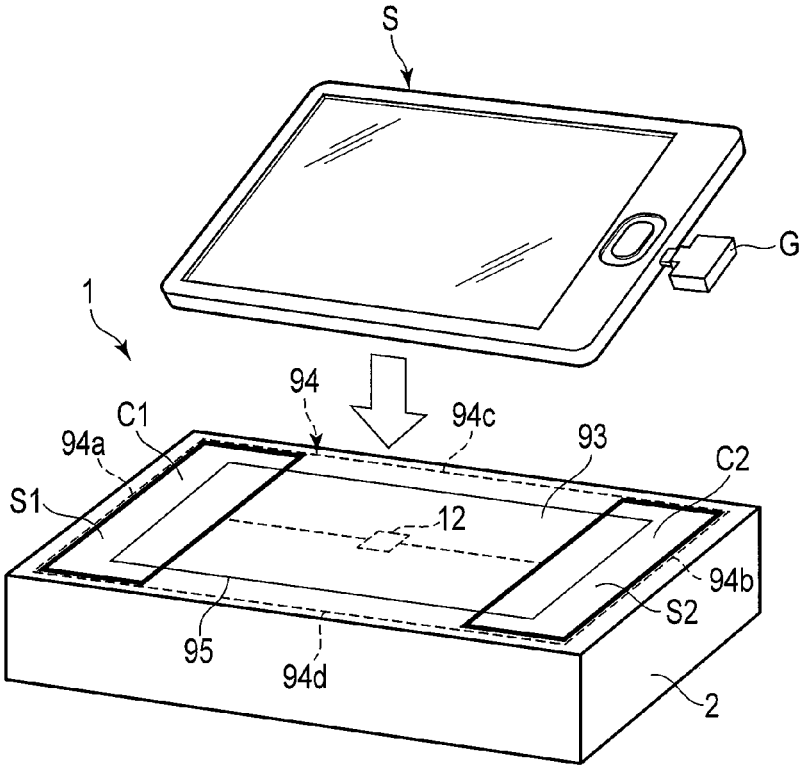
FIG. 21 is an exemplary perspective illustration showing an antenna arrangement of the electronic device shown in FIG. 18.

FIG. 21 shows an arrangement example of the first and second antennas C1 and C2 on the upper surface 93.

Each of the first and second antennas C1 and C2 receives and transmits an electromagnetic wave by electromagnetic coupling between antenna C1 or C2 and another antenna. Antennas C1 and C2 function as antennas (i.e., couplers) used for close proximity wireless communication.

In the smartphone S, an antenna for close proximity wireless communication may be housed in the housing of the smartphone S. Alternatively, a small adapter (i.e., dongle) G configured to perform close proximity wireless communication may be attached to the smartphone S as shown in FIG. 21. The dongle G is an adapter comprising an antenna and a close proximity wireless communication module. The dongle (i.e., adapter) G may be, for example, a micro-USB dongle (i.e., adapter) comprising a micro-USB interface. In this case, the dongle G is inserted into a micro-USB connector of the smartphone S.

Antennas C1 and C2 are provided in the communication region 94 of the upper surface 93. Antennas C1 and C2 are provided along two sides facing each other (i.e., two shorter sides facing each other) in the communication region 94. The first antenna C1 is provided along a first side 94*a* of the communication region 94. The second antenna C2 is provided along a second side 94*b* of the communication region 94. The second side 94*b* is located on a side opposite to the first side 94*a*. The shape of each of antennas C1 and C2 may be any shape of the above first to fifth embodiments.

Similarly to the first embodiment, the electronic device 1 comprises a distributor 12, a controller 51 and a communication module 13. In the present embodiment, the distributor 12 sends a signal from the communication module 13 to two antennas C1 and C2.

In the antenna arrangement shown in FIG. 21, the antenna of the smartphone S can face one of the first and second antennas C1 and C2 of the box 91 when the orientation of the smartphone S placed in the communication region 94 of the upper surface 93 is either the orientation shown in FIG. 21 or the orientation rotated 180 degrees around from FIG. 21. Therefore, the antenna arrangement of FIG. 21 realizes stable data communication between the smartphone S and the box 91 regardless of the orientation of the smartphone S placed on the upper surface 93.

According to the above structure, similarly to the first embodiment, the convenience of the electronic device 1 can be enhanced.

[Modification Example of Sixth Embodiment]

Figure 22:
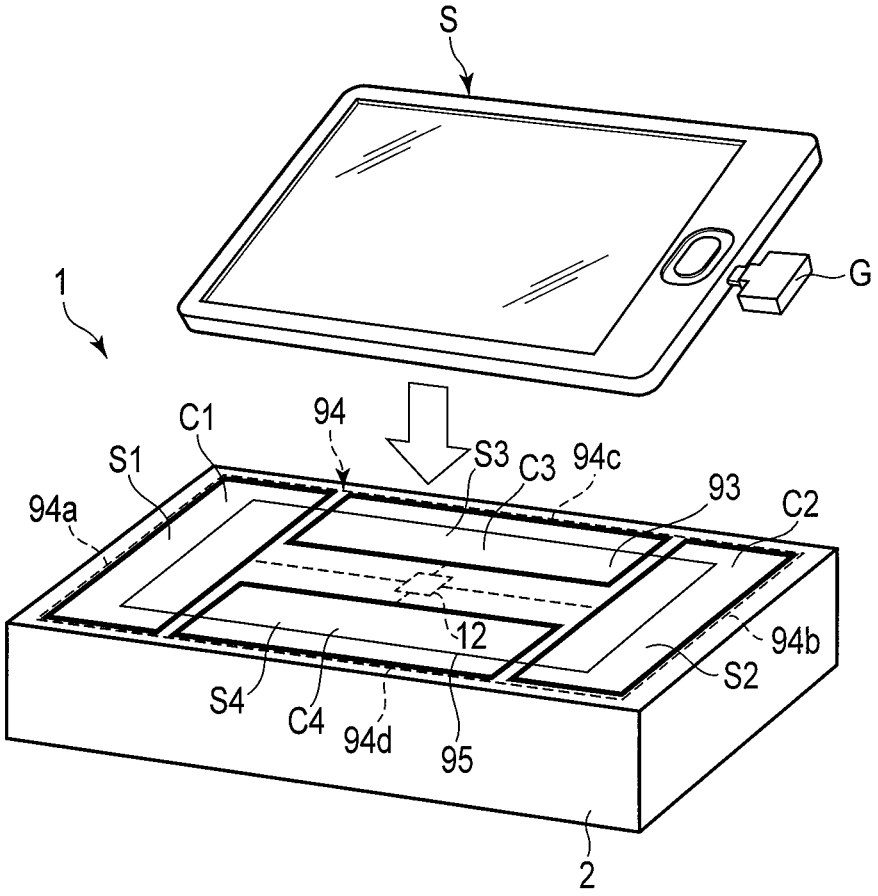
FIG. 22 is an exemplary perspective illustration showing an antenna arrangement of a modification of the electronic device shown in FIG. 18.

FIG. 22 shows a modification example of an antenna module 5 in the communication region 94 of the upper surface 93. In the antenna arrangement shown in FIG. 22, the antenna module 5 includes third and fourth antennas C3 and C4 in addition to the first and second antennas C1 and C2. The third and fourth antennas C3 and C4 are provided along the other two sides 94*c* and 94*d* of the communication region 94.

Specifically, the third antenna C3 is provided along the third side 94*c* of the communication region 94. The third antenna C3 is located between the first and second antennas C1 and C2. The fourth antenna C4 is provided along the fourth side 94*d* of the communication region 94. The fourth antenna C4 is also located between the first and second antennas C1 and C2.

The shape of each of antennas C1, C2, C3 and C4 may be any shape of the above first to fifth embodiments. In the present modification example, the distributer 12 sends a signal from the communication module 13 to four antennas C1, C2, C3 and C4.

According to the above structure, similarly to the first embodiment, the convenience of the electronic device 1 can be enhanced. Further, according to the present embodiment, antennas C1, C2, C3 and C4 are provided in four end regions along four sides of the communication region 94 respectively. This arrangement enables further relaxation of restrictions on the position or orientation of the smartphone S to be placed.

The electronic device 1 according to the first to sixth embodiments is explained above. However, embodiments of the present invention are not limited to the first to sixth embodiments. For example, the first to eighth antennas C1 to C8 and the distributer 12 may not be provided in one printed board 11. The first to eighth antennas C1 to C8 and the distributor 12 may be provided separately in a plurality of members. For example, the first to eighth antennas C1 to C8 may be directly formed on the inner surface of the housing 2 by printing.

The first to eighth antennas C1 to C8 are not limited to antennas formed by a wiring pattern, and may be stereoscopic antennas comprising a coupling element away from the printed board 11. The distributor 12 is not limited to a distributor which distributes a signal to eight antennas. The distributor 12 may be a distributor which distributes a signal to two antennas or four antennas or comprises other structures. The antenna connected to the distributor 12 is not limited to an antenna for close proximity wireless communication.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An electronic device comprising:

a housing comprising a communication region comprising a first region and a second region;

a printed board in the communication region;

a first antenna on the printed board, the first antenna being in the first region;

a second antenna on the printed board, the second antenna being in the second region;

a distributor on the printed board;

a wiring pattern on the printed board, the wiring pattern connecting each of the first antenna and the second antenna to the distributor;

a communication module electrically connected to the distributor, the communication module configured to perform close proximity wireless communication by using the first antenna when an antenna of an external device approaches the first region and to perform close proximity wireless communication by using the second antenna when the antenna of the external device approaches the second region; and a positional information obtaining unit configured to obtain positional information of the external device, wherein based on the positional information of the external device from the positional information obtaining unit, the communication module is configured to transmit first data when the external device approaches the first region and to transmit second data which is different from the first data when the external device approaches the second region.

2. The electronic device of claim 1, further comprising a third antenna in a third region of the communication region, wherein the communication module is configured to perform close proximity wireless communication by using the third antenna when the antenna of the external device approaches the third region.

3. The electronic device of claim 2, wherein the printed board comprises a first end portion and a second end portion intersecting with the first end portion, and the first antenna is in the first end portion of the printed board, and the second antenna is in the second end portion of the printed board.

4. The electronic device of claim 3, wherein the printed board comprises a third end portion on a side opposite to the first end portion, and the third antenna is in the third end portion of the printed board.

5. The electronic device of claim 1, wherein the first region comprises a first displayed illustration, and the second region comprises a second displayed illustration, the first data comprises content corresponding to the first displayed illustration, and the second data comprises content corresponding to the second displayed illustration.

6. The electronic device of claim 1, wherein the first antenna comprises a first coupling element extending in a first direction, and the second antenna comprises a second coupling element extending in a second direction intersecting with the first direction.

7. The electronic device of claim 6, wherein the first coupling element comprises a first open end, a second open end, and a connecting point located between the first open end and the second open end, the first antenna comprises a connecting element electrically connected to the connecting point of the first coupling element, and a current from a feed-point is supplied to the connecting element, an electrical length between the first open end and the connecting point of the first coupling element is an odd multiple of ¼ of a wavelength $\lambda$ corresponding to a frequency used for the close proximity wireless communication, and an electrical length of the connecting element is an odd multiple of ¼ of the wavelength $\lambda$.

8. The electronic device of claim 7, wherein the electrical length between the first open end and the connecting point of the coupling element is $n \times \lambda/4$, the electrical length of the connecting element is $m \times \lambda/4$, n is an odd number greater than or equal to three, and m is an odd number greater than or equal to three.

9. The electronic device of claim 1, wherein when the antenna of the external device approaches the first region, the antenna of the external device is closer to the first region than to the second region, and when the antenna of the external device approaches the second region, the antenna of the external device is closer to the second region than to the first region.

* * * * *